United States Patent [19]

Kurematsu et al.

[11] Patent Number: 4,895,786

[45] Date of Patent: Jan. 23, 1990

[54] PROCESS FOR STABILIZING PHOTOSENSITIVE MATERIALS TO REPLACE EXHAUSTIVE WASHING

[75] Inventors: Masayuki Kurematsu, Hino; Shigeharu Koboshi, Sagamihara, both of Japan

[73] Assignee: Konishiroku Photo Industry Co., Ltd., Tokyo, Japan

[21] Appl. No.: 351,268

[22] Filed: May 11, 1989

Related U.S. Application Data

[63] Continuation of Ser. No. 258,067, Oct. 14, 1988, abandoned, which is a continuation of Ser. No. 147,082, Jan. 20, 1988, abandoned, which is a continuation of Ser. No. 820,673, Jan. 21, 1986, abandoned.

[30] Foreign Application Priority Data

Jan. 24, 1985 [JP] Japan ..... 60-12198

[51] Int. Cl.[4] ..... G03C 5/16

[52] U.S. Cl. ..... 430/139; 430/372; 430/428; 430/429; 430/432; 430/463; 430/486; 430/517; 430/520; 430/521; 430/522; 430/551

[58] Field of Search ..... 430/139, 372, 428, 429, 430/432, 463, 486, 517, 520, 521, 522, 551

[56] References Cited

U.S. PATENT DOCUMENTS

| | | | |
|---|---|---|---|
| 3,247,127 | 4/1966 | Bailey et al. | 430/522 |
| 3,540,887 | 11/1970 | Depoorter et al. | 430/580 |
| 3,575,704 | 4/1971 | Salesin et al. | 430/521 |
| 3,653,905 | 4/1972 | Depoorter et al. | 430/522 |
| 4,033,771 | 7/1977 | Borton et al. | 96/60 |
| 4,277,556 | 7/1981 | Koboshi et al. | 430/393 |
| 4,336,324 | 6/1982 | Koboshi et al. | 430/372 |
| 4,440,852 | 4/1984 | Onishi et al. | 430/522 |
| 4,562,144 | 12/1985 | Kurematsu et al. | 430/463 |
| 4,564,590 | 1/1986 | Sasaki et al. | 430/551 |
| 4,587,195 | 5/1986 | Ishikawa et al. | 430/139 |

FOREIGN PATENT DOCUMENTS

| | | |
|---|---|---|
| 3223148 | 1/1983 | Fed. Rep. of Germany . |
| 1190855 | 5/1970 | United Kingdom . |

OTHER PUBLICATIONS

Patent Abstracts of Japan, vol. 7, No. 249 (p. 234), [1394], Nov. 5, 1983; & JP-A-58 132 742 (Konishiroku Shashin Kogyo K.K.), 08-08-1983.

Patent Abstracts of Japan, vol. 9, No. 44 (p. 337), [1767], Feb. 23, 1985; & JP-A-59 184 345 (Konishiroku Shashin Kogyo K.K.), 19-10-1984.

*Primary Examiner*—Paul R. Michl

*Assistant Examiner*—Janet C. Baxter

*Attorney, Agent, or Firm*—Frishauf, Holtz, Goodman & Woodward

[57] ABSTRACT

In a processing method for silver halide color photosensitive material in which silver halide color photosensitive material is treated to produce a color dye image with a processing solution that has a fixing ability, and subsequently is not washed but treated with a washless stabilizing solution, the improvement comprising treating said silver halide color photosensitive material with a washless stabilizing solution that contains a triazinylstilbene optical brightening agent in the presence of an amount sufficient to stabilize the dye image and reduce staining of the photosensitive material of at least one compound represented by General Formula (I), (II), (II') or (II''):

General Formula (I):

General Formula (II):

General Formula (II'):

General Formula (II''):

18 Claims, No Drawings

PROCESS FOR STABILIZING PHOTOSENSITIVE MATERIALS TO REPLACE EXHAUSTIVE WASHING

BACKGROUND OF THE INVENTION

The invention relates to a processing method for silver halide color photosensitive material (hereinafter referred to as photosensitive material) in which the washing process is omitted, and more specifically relates to a washless processing method of photosensitive material to prevent unexposed area from staining by continuous processing.

In general, the photosensitive material after color development is submitted to treating processes including bleaching, fixing, stabilizing, bleach-fixing and washing. In such treating processes, the extensive use of water resources and the increase in costs of washing due to the raising costs of crude oil have recently posed more and more serious problems.

For this reason, techniques have been proposed which omit the washing process or greatly reduce the amount of washing water. These techniques are the stabilizing technique by multistage countercurrent stabilizing treatment described in Japanese Patent O.P.I. Publication No. 8543/1982 which corresponds to U.S. Pat. No. 4,336,324, and the treating technique by washless stabilizing solution containing bismuth complex salt described in Japanese Patent O.P.I. Publication No. 134636/1983.

In such a treatment with washless stabilizing solution, however, the inventor found that color contamination took place in treated photosensitive material and resulted in remarkable stains when the total volume of the replenisher to be supplied to the stabilizing tank solution amounted to more than 6 to 7 times capacity of the stabilizing tank. The color contamination or stains are especially significant in unexposed areas, and are a particular problems in color paper whose unexposed areas are white, where even slight stains poses serious defects.

It was found that the generation of such stains adversely affected durability of dye images during preservation, especially under light irradiation.

SUMMARY OF THE INVENTION

One of objects of the invention is to present a technical means to prevent unexposed areas of photosensitive material from staining which would take place when said photosensitive material is continuously treated with a washless stabilizing solution.

The other objects of the invention is to provide a means to provide color image stability, especially light stability after continuous treatment with a washless stabilizing solution.

As a result of elaborate studies, the inventors found that, in a processing method of photosensitive material after color development, with which was treated with a processing solution that had a fixing ability, and subsequently was not washed but was treated with a washless stabilizing solution, the above objects of the invention were attained by treating said silver halide color photosensitive material with a washless stabilizing solution which contained a triazinylstilbene optical brightening agent in the presence of at least one compound represented by General Formula [I], [II], [II'], or [II''] described below:

General Formula [I]:

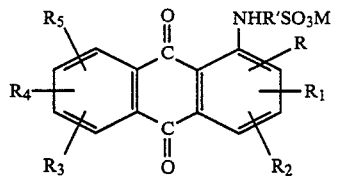

where each of R, $R_1$, $R_2$, $R_3$, $R_4$ and $R_5$ is a hydrogen or halogen atom, or a hydroxy, alkyl, alkoxy, sulfo or —NHR'$SO_3M$ group; R' is an alkylene group, and M is a cationic group.

General Formula [II]:

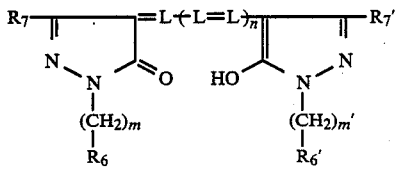

where each of $R_6$ and $R_6'$ is a hydrogen atom, or an alkyl, aryl or heterocyclic group; each of $R_7$ and $R_7'$ is a hydroxy, alkoxy, cyano, trifluoromethyl, —$COOR_8$, —$CONHR_8$, —$NHCOR_8$, ureido, imino, amino, $C_{1-4}$-alkyl-substituted amino group, or a cyclic amino group represented by

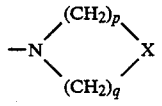

(where each of p and q is the integer 1 or 2; X is an oxygen or sulfur atom, or a —$CH_2$— group); $R_8$ is a hydrogen atom, or an alkyl or aryl group; L is a methine group; n is the integer 0, 1 or 2; each of m and m' is the integer 0 or 1.

General Formula [II']:

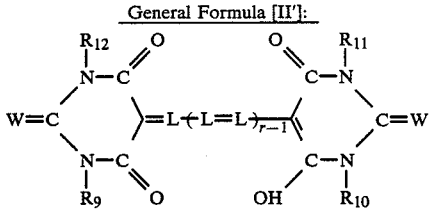

where r is the integer 1, 2 or 3; W is an oxygen or sulfur atom; L is a methine group; each of $R_9$ to $R_{12}$ is a hydrogen atom, or an alkyl, aryl, aralkyl or heterocyclic group; and at least one of $R_9$ to $R_{12}$ is a substituent group other than a hydrogen atom.

General Formula [II'']:

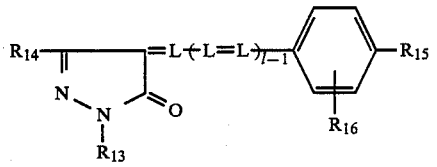

where l is the integer 1 or 2; L is a methine group; $R_{13}$ is an alkyl, aryl or heterocyclic group; each of $R_{14}$ and $R_{15}$ is hydroxy, alkyl, alkoxy, cyano, trifluoromethyl, —$COOR_8$, —$CONHR_8$, —$NHCOR_8$, ureido, imino, amino, $C_{1-4}$-alkyl-substituted amino group, or a cyclic amino group represented by

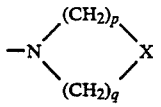

where each of p and q is the integer 1 or 2; X is an oxygen or sulfur atom, or a —$CH_2$— group); $R_8$ is a hydrogen atom, or an alkyl or aryl group; and $R_{16}$ is a hydrogen or chlorine atom, or an alkyl or alkoxy group.

The inventor found also that, in a preferred embodied mode of the invention, the effects of the invention were particularly noticeable when said washless stabilizing solution had its pH ranging from 3.0 to 11.0.

In addition, the inventor found that the objects of the invention were attained more effectively when the maximum fluorescent wavelength $\lambda_{max}$ of said triazinylstilbene optical brightening agent was 433 to 440 nm.

According to the continuous processing method with use of washless stabilizing solution of the invention, the prevention of both the possible staining of unexposed areas and the preservative stability (especially light-fading stability) of dye image are much improved.

DETAILED DESCRIPTION OF THE INVENTION

Further description of the invention is given as follows:

In conventional washing treatment processes after developing, bleaching and fixing treatments, all of processing solution components, which included color developers, benzyl alcohol, bleaching agents, and thiosulfates, and their reaction products and oxidation products were washed out of the inside and surface of the photosensitive material by a large amount of washing water. In a washless treatment with "washless" stabilizing solution, all these components necessarily are eluted into and accumulated in said stabilizing solution. When the replenishing amount of stabilizing solution is relatively small, the above eluted substances increasingly accumulate in the stabilizing solution. Furthermore, they remain in the stabilizing solution for a long period because of a poor renewal rate of the stabilizing solution, resulting in the improvement of the oxidation of said substances therein. The washless stabilizing solution becomes considerably colored due to the contamination with colored components of these oxidation products. Such colored components are believed to be adsorbed by the photosensitive material, whose unexposed areas are thereby stained.

The invention is based on the finding that, when the photosensitive material is treated with a washless stabilizing solution containing a triazinylstilbene optical brightening agent in the presence of a compound represented by General Formula [I], [II], [II'], or [II''], the contamination of said stabilizing solution which possibly takes place during long continuous processing operation, and the consequent decrease in preservative stability of the obtained dye image can be prevented. The aforementioned objects of the invention require the combined use of the triazinylstilbene optical brightening agent and the compound of Formula (I), (II), (II'), or (II'').

The compound represented by General Formula [I], [II], [II'], or [II''] in the invention commonly has its absorption maximum in the visible region, and known as a dyestuff usable in photosensitive materials. On the other hand, such a triazinylstilbene optical brightening agents is known to be useful as an additive to a color developer or a postwashing stabilizing solution. It is however an entirely unknown, surprising fact that the above problems inherent to washless stabilizing solution can be resolved by the combined use of both of the above substances.

Supposedly such effects of the invention are based on the prevention of the adsorption of the above colored components onto the photosensitive material by these substances.

Further description of the compound represented by General Formula [I], [II], [II'], or [II''] in the invention is given below.

General Formula [I]:

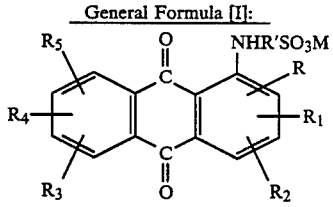

In this formula, each of R, $R_1$, $R_2$, $R_3$, $R_4$ and $R_5$ is a hydrogen atom, a halogen atom (for example chlorine, bromine or fluorine), or a hydroxy, alkyl (preferably $C_1$ to $C_4$; for example methyl, ethyl or propyl), alkoxy (preferably $C_1$ to $C_4$; for example methoxy, ethoxy or propoxy), —$SO_3M$ or —$NHR'SO_3M$ group, where R' is an alkylene group (for example methylene or ethylene); M is a hydrogen atom, an alkali metal atom (for example sodium or potassium), or a cationic group such as an ammonium, or organic ammonium group (for example pyridinium, piperidinium, triethylammonium or triethanolamine).

Typical compounds represented by General Formula [I] are shown as follows, but the invention is not limited to them:

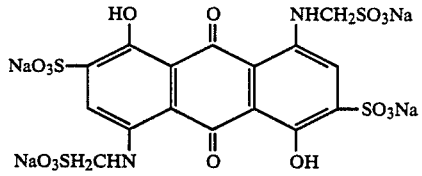

(A-1)

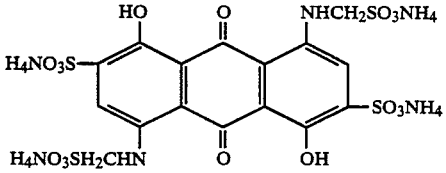

(A-2)

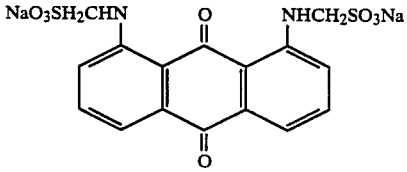

(A-3)

-continued

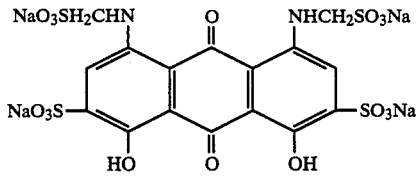

(A-4)

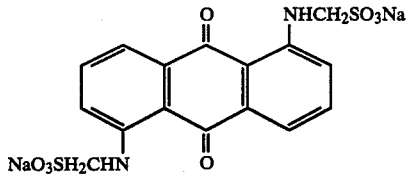

(A-5)

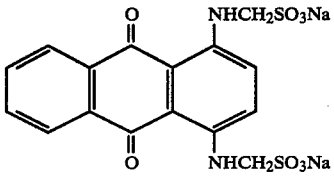

(A-6)

General Formula [II]:

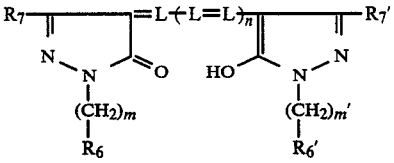

In this formula, each of $R_6$ and $R_6'$ is a hydrogen atom, or an alkyl, aryl or heterocyclic group which is allowed to be substituted; said alkyl group is allowed to be linear, branched or cyclic, but preferably with 1 to 4 carbon atoms like an ethyl or β-sulfoethyl group, for example. The above aryl group is a phenyl, or naphthyl group, for example, and is allowed to have a substituent group such as a sulfo group (which is allowed to be combined with said aryl group through a divalent organic group such as a phenyleneoxy, alkylene, alkyleneamino, or alkyleneoxy group), a carboxy group, an alkyl group (with 1 to 5 carbon atoms, for example a methyl or ethyl group), a halogen atom (for example chlorine or bromine), an alkoxy group (with 1 to 5 carbon atoms, for example methoxy or ethoxy), or a phenoxy group, and is for example, a 4-sulfophenyl, 4-(δ-sulfobutyl)phenyl, 3-sulfophenyl, 2,5-disulfophenyl, 3,5-disulfophenyl, 6,8-disulfo-2-naphtyl, 4,8-disulfo-2-naphtyl, 3,5-dicarboxyphenyl, 4-carboxyphenyl, 4-(4-sulfophenoxy)phenyl, 4-(2-sulfoethyl)phenyl, 3-(sulfomethylamino)phenyl, or 4-(2-sulfoethoxy)phenyl group.

The above heterocyclic group is, for example, a 2-(6-sulfo)benzothiazolyl or 2-(6-sulfo)benzoxazolyl group, and is allowed to have a substituent group such as a halogen atom (for example chlorine, bromine or fluorine), or an alkyl (for example methyl or ethyl), aryl (for example phenyl), carboxy, sulfo, hydroxy, alkoxy (for example methoxy), or aryloxy (for example phenoxy) group.

In General Formula [II], each of $R_7$ and $R_7'$ is a hydroxy, alkoxy (preferably with 1 to 4 carbon atoms; for example methoxy, ethoxy, isopropoxy, or n-butoxy), substituted alkoxy (for example halo- or $C_{1-2}$-alkyl-$C_{1-4}$-alkoxy, such as β-chloroethoxy, or β-methoxyethoxy), cyano, trifluoromethyl, —$COOR_8$, —$CONHR_8$, —$NHCOR_8$ (where $R_8$ is a hydrogen atom, or preferably a $C_{1-4}$ alkyl, or aryl group which is allowed to have a sulfo or carboxy group as a substituent), ureido, imino, amino, or $C_{1-4}$ -alkyl-substituted amino (for example ethylamino, dimethylamino, diethylamino, or di-n-butylamino) group, or a cyclic amino group represented by

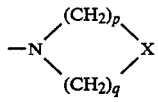

(where each of p and q is the integer 1 or 2; X is an oxygen or sulfur atom, or a —$CH_2$— group) (for example a morpholino, piperidino, or piperazino group).

In General Formula [II], the methine group represented by L is allowed to be substituted with a $C_{1-4}$-alkyl (for example methyl, ethyl, isopropyl or tert-butyl), or aryl (for example phenyl or tolyl) group.

At least one group of sulfo, sulfoalkyl and carboxy groups which belong to the above cyclic group is allowed to form its salt with an alkali earth metal such as calcium or magnesium, ammonia or an organic base such as diethylamine, triethylamine, morpholine, pyridine or piperidine. In General Formula [II], n is the integer 0, 1 or 2; each of m and m' is the integer 0 or 1.

Typical compounds represented by General Formula [II] are shown as follows, but the invention is not limited to them:

Exemplified Compounds:

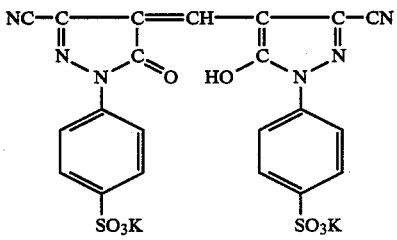

(B-1)

-continued
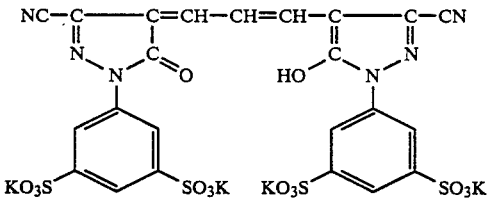
(B-2)
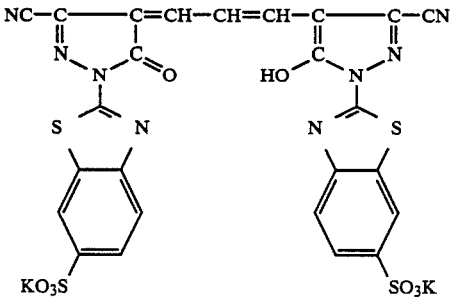
(B-3)
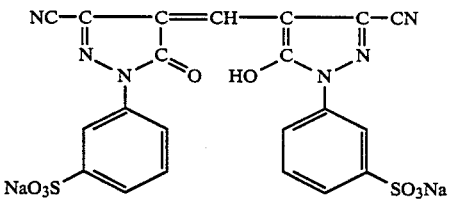
(B-4)
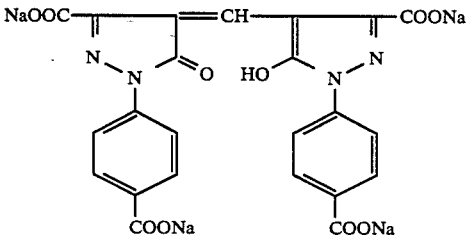
(B-5)
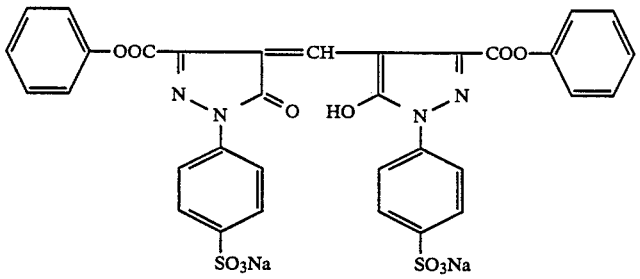
(B-6)
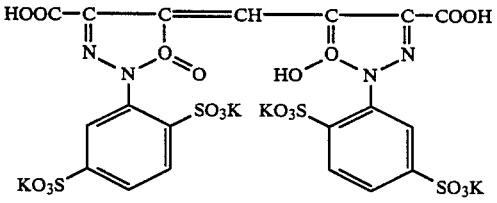
(B-7)

-continued
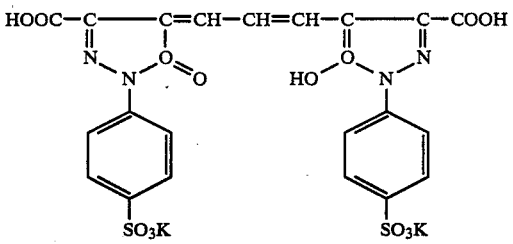
(B-8)
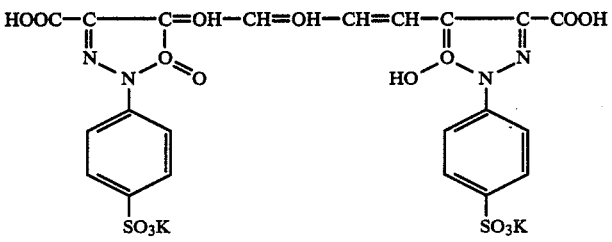
(B-9)
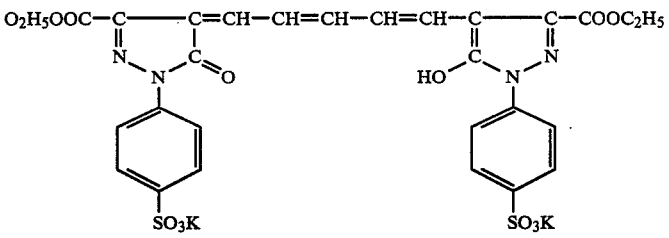
(B-10)
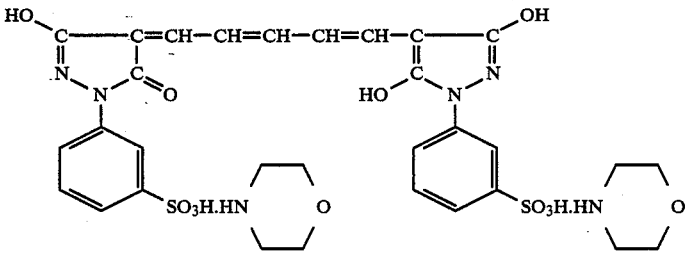
(B-11)
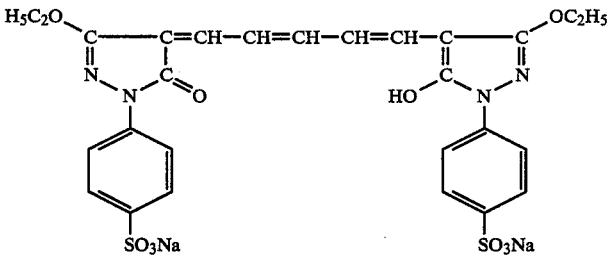
(B-12)
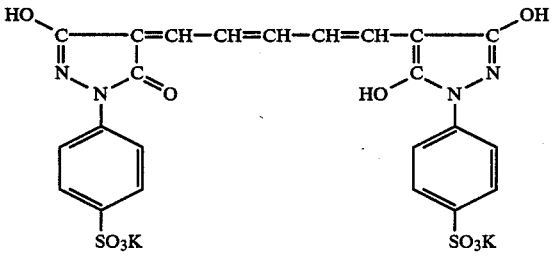
(B-13)

-continued
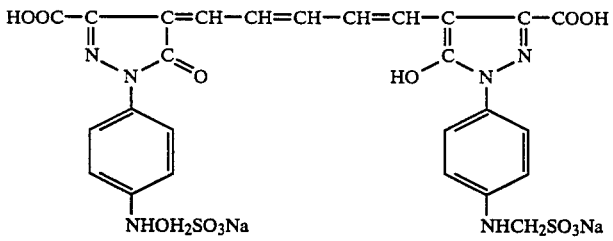
(B-14)
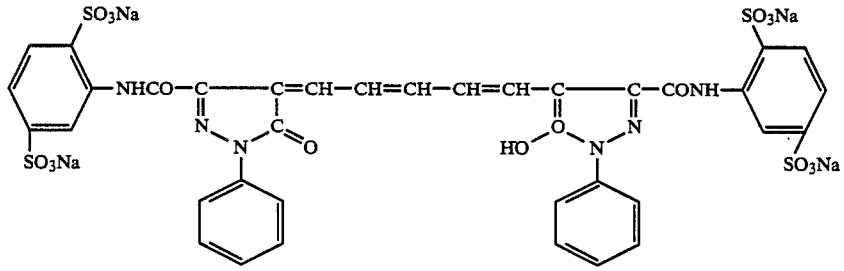
(B-15)
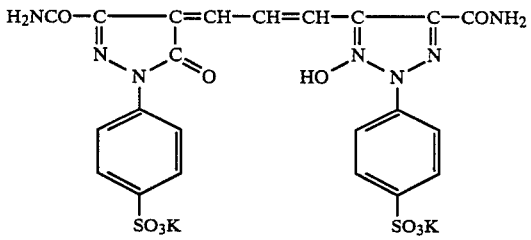
(B-16)
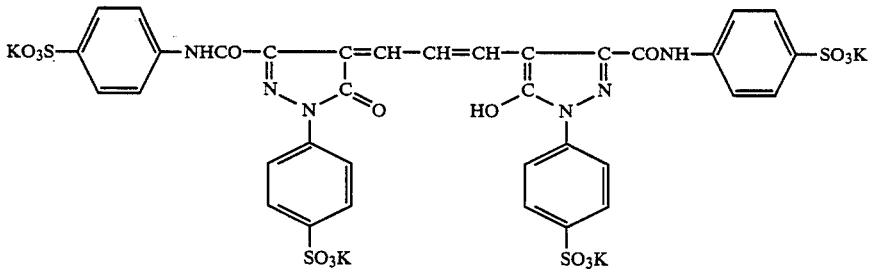
(B-17)
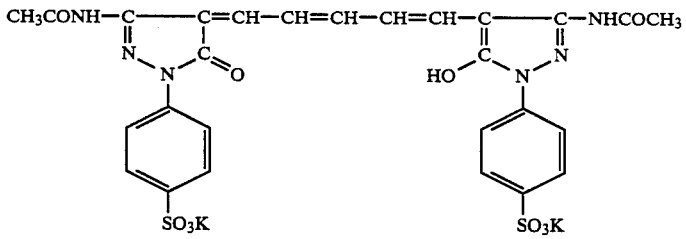
(B-18)
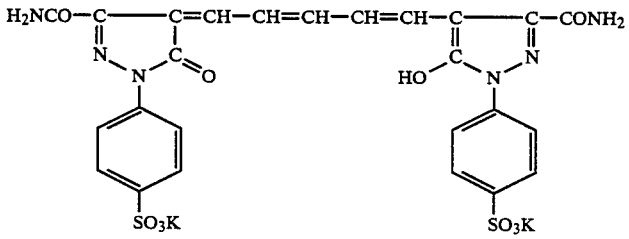
(B-19)

-continued
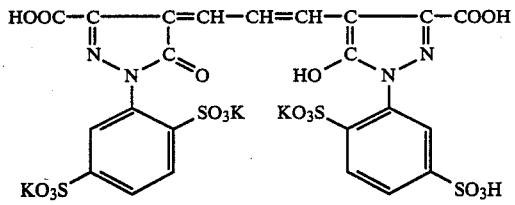
(B-20)
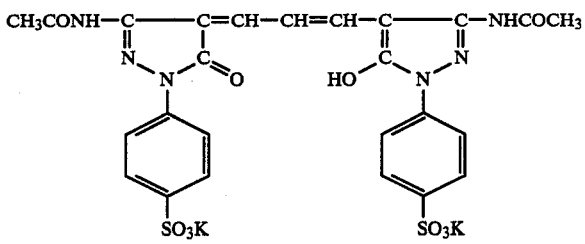
(B-21)
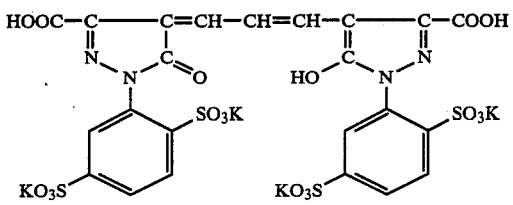
(B-22)
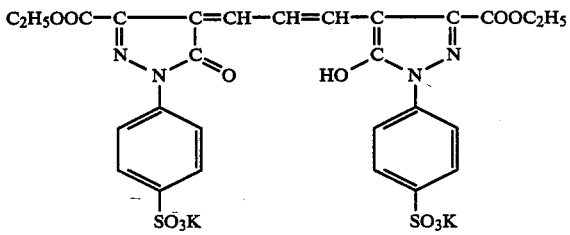
(B-23)
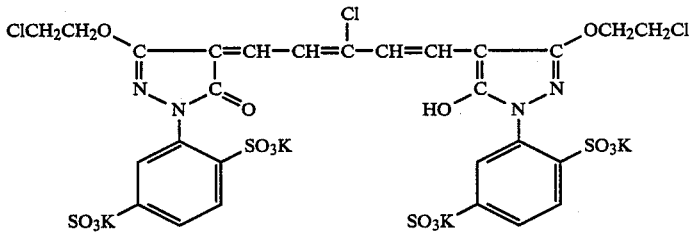
(B-24)
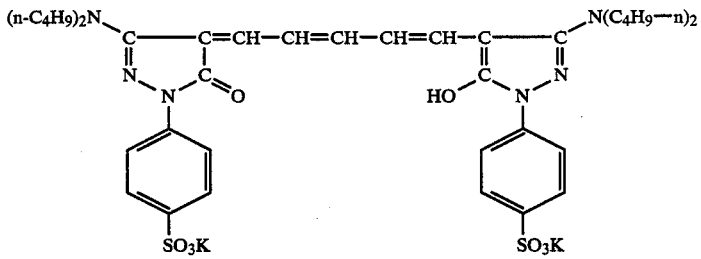
(B-25)
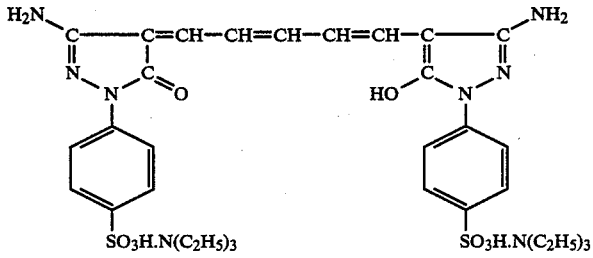
(B-26)

-continued (B-27)

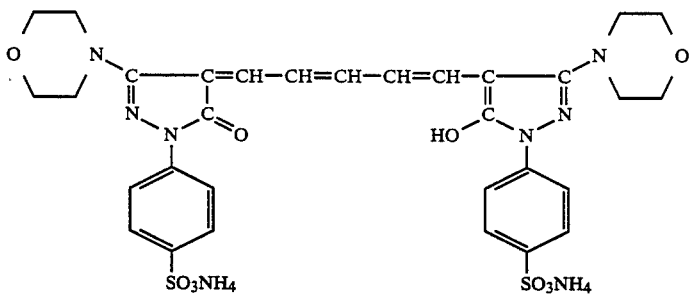

(B-28)

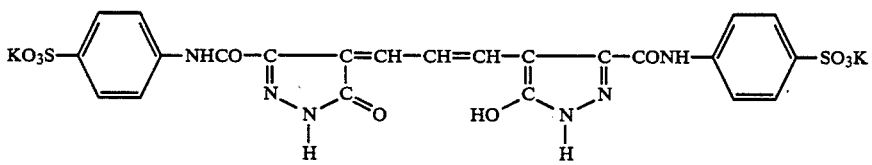

(B-29)

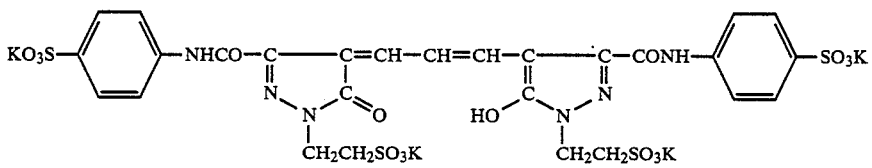

General Formula [II']:

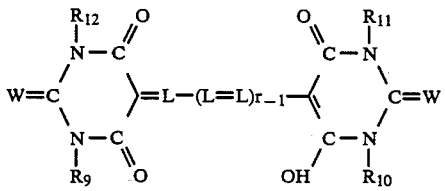

In this formula, r is the integer 1, 2 or 3; W is an oxygen or sulfur atom; L is a methine group; each of $R_9$ to $R_{12}$ is a hydrogen atom, or an alkyl, aryl, aralkyl or heterocyclic group; and at least one of $R_9$ to $R_{12}$ is a substituent group other than a hydrogen atom.

In General Formula [II'], the methine group represented by L is allowed to be the same as for General Formula [II]. The alkyl group represented by $R_9$ to $R_{12}$ is allowed to be the same as for $R_6$ or $R_6'$ in General Formula [II], and is allowed to have a substituent group which is cited for $R_6$ or $R_6'$ in General Formula [II] but is preferably a sulfo, carboxy, hydroxy, alkoxy, alkoxycarbonyl, cyano, or sulfonyl group. The aryl group represented by $R_9$ to $R_{12}$ is preferably a phenyl group, and a substituent group which is introduced onto said phenyl group is allowed to be the same as that which is introduced onto the $R_6$ or $R_6'$ in General Formula [II] but preferably has at least one sulfo, carboxy or sulfamoyl group on its aromatic nucleus. The aralkyl group represented by $R_9$ to $R_{12}$ is preferably a benzyl or phenetyl group, and the substituent group which is introduced onto its aromatic nucleus is allowed to be the same as that which the abovementioned aryl group of $R_9$ to $R_{12}$ has. The heterocyclic group represented by $R_9$ to $R_{12}$ is, for example, a pyridyl or pirimidyl group, and the substituent group which is introduced onto its heterocyclic ring is allowed to be the same as that which the abovementioned aryl group of $R_9$ to $R_{12}$ has. The group represented by $R_9$ to $R_{12}$ is preferably an alkyl or aryl group, and especially it is preferable that the barbituric acid or thiobarbituric acid molecule in General Formula [II'] has at least one carboxy, sulfo, or sulfamoyl group, even possibly symmetrically.

Thus, typical compounds represented by General Formula [II'] are shown as follows, but the invention is not limited to them:

(C-1)

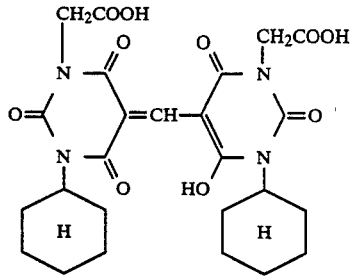

(C-2)

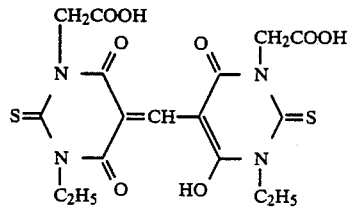

-continued (C-3)

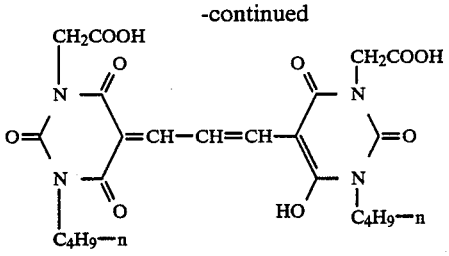

(C-4)

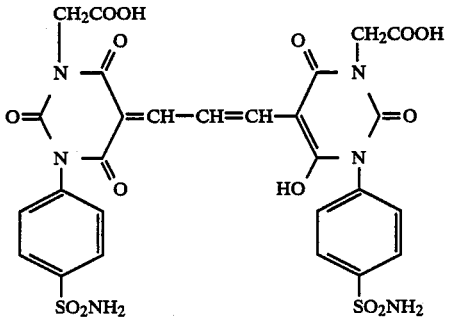

(C-5)

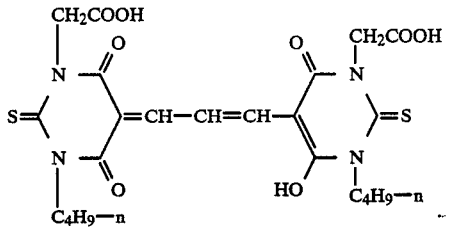

(C-6)

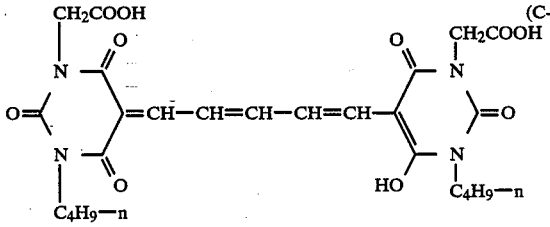

-continued (C-7)

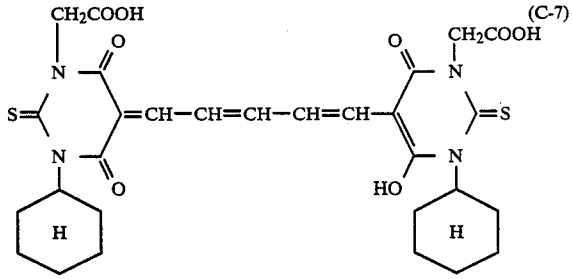

General Formula [II'']:

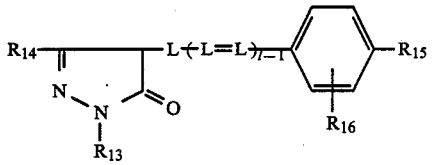

In this formula, l is the integer 1 or 2; L is a methine group; the alkyl, aryl or heterocyclic group represented by $R_{13}$ has the same implication as to $R_6$ or $R_6'$ in General Formula [II], and $R_{13}$ is preferably an alkyl or aryl group; said aryl group has preferably at least one sulfo group.

Each of $R_{14}$ and $R_{15}$ can have any substituent group which is introduced into $R_7$ and $R_7'$ in General Formula [II]; said substituent group is preferably selected from among alkyl, carboxy, alkoxycarbonyl, carbamoyl, ureido, acylamino, imino and cyano groups. The alkyl group represented by $R_{14}$ is allowed to be linear, branched or cyclic, preferably with 1 to 6 carbon atoms, and is allowed to have a substituent group such as a hydroxy, carboxy or sulfo group, so is a methyl, ethyl, isopropyl, n-butyl, or hydroxyethyl group, for example.

In an alkoxy- or alkyl- or alkyl-substituted amino group represented by $R_{14}$ or $R_{15}$, said alkyl group is for example, a methyl, ethyl, butyl, hydroxyalkyl such as β-ethoxyethyl, carboxyalkyl such as β-carboxyethyl, alkoxycarbonylalkyl such as β-ethoxycarbonylethyl, or cyanoalkyl such as β-cyanoethyl, sulfoalkyl such as β-sulfoethyl and γ-sulfopropyl group.

$R_{14}$ is a hydrogen or chlorine atom, or an alkyl or alkoxy group; said alkyl group is a methyl or ethyl group, for example, and said alkoxy group is a methoxy or ethoxy group, for example.

Typical compounds represented by General Formula [II''] are shown as follows, but the invention is not limited to them:

(D-1)

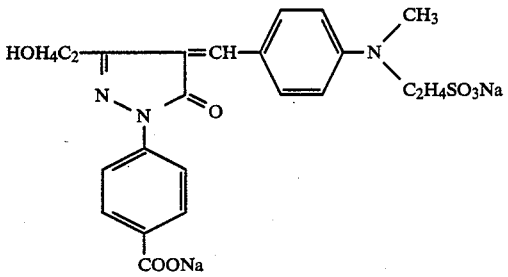

-continued
(D-2)
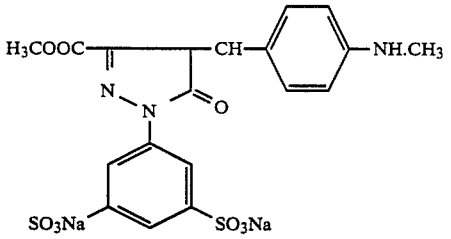
(D-3)
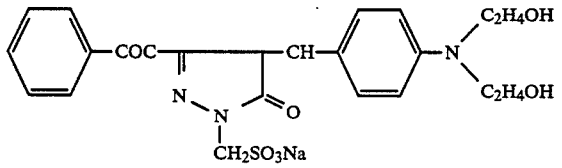
(D-4)
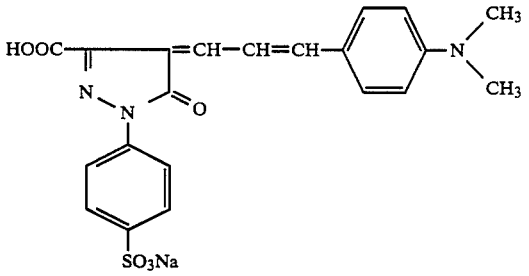
(D-5)
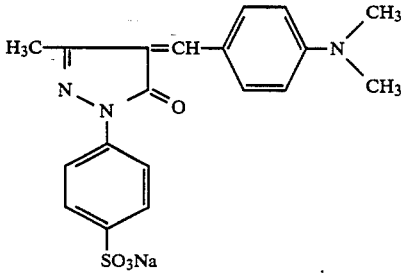
(D-6)
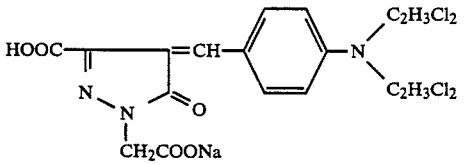
(D-7)
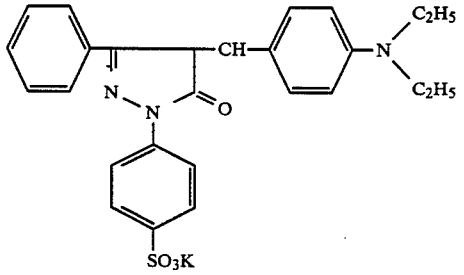

-continued (D-8)

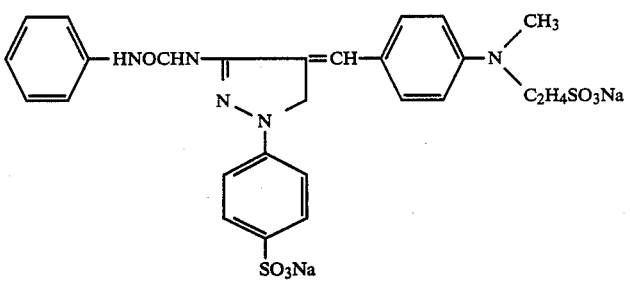

Each compound represented by General Formula [I], [II], [II'], or [II''] can be synthesized with the synthetic method described in the specification of U.S. Pat. Nos. 3,575,704, 3,247,127, 3,540,887, or 3,653,905, or Japanese Patent O.P.I. Publication Nos. 85130/1973, 99620/1974, 111640/1984, 111641/1984, or 170838/1984.

To treat a photosensitive material with a washless stabilizing solution in the presence of a compound represented by General Formula [I], [II], [II'], or [II''], said compound is allowed to be used by directly adding to said washless stabilizing solution, by adding to the forebath to adhere to the photosensitive material, or to be incorporated into the photosensitive material. In case to be incorporated into the photosensitive material, said compound is allowed to be made to be contained into any of silver halide emulsion layers and/or other hydrophilic colloidal layers of the photosensitive material. Alternatively, said compound is allowed to be dissolved as its organic or inorganic salt into an applying liquid such as an emulsion at an appropriate concentration, and to be applied onto the photosensitive material with a certain well-known procedure. What is essential and preferable is that said compound is added to a certain emulsion layer or its adjacent layer. Said compound is added at a rate ranging from 1 to 800 mg, preferably from 2 to 200 mg per $m^2$ of photosensitive material. In case of addition to said washless stabilizing solution, it is added at a concentration ranging from 0.005 to 200 mg, preferably from 0.01 to 50 mg per liter of solution.

Among compounds represented by General Formula [I], [II], [II'], or [II''], those represented by General Formula [II] are particularly preferred. The combined use of two or more of these compounds is preferred in terms of the effective mode of the invention.

In case that the compound represented by General Formula [I], [II], [II'], or [II''] is incorporated into the photosensitive material, and is eluted into the washless stabilizing solution, the concentration of the eluted compound in the stabilizing solution depends on not only the replenishing amount of the stabilizing solution per unit area of the photosensitive material, but also on conditions including the treating time and temperature with the color developer and the bleach-fixer preceding the washless stabilizing treatment.

An excessively long time or high temperature of the treatment with the color developer or the bleach-fixer is not desirable because said compound may be too early eluted out thereby. Such treatments before the stabilizing treatment should be got through within 8 minutes, preferably within 6 minutes, and most desirably within 4½minutes. The temperature of such treatments is preferably lower than 50°0 C. As for the replenishing amount of the processing solution during a continuous treating operation, the total replenishing amount of the color developer and the bleach-fixer should be less than one (1) liter, preferably less than 600 ml per $m^2$ of the photosensitive material; the replenishing amount of the washless stabilizing solution should be less than 2 liters, preferably less than one (1) liter, and most desirably less than 500 ml per $m^2$ of the photosensitive material.

In case that the photosensitive material is incorporated into with the compound represented by General Formula [I], [II], [II'], or [II''], and treated with the processing solution according to the above temperature, time, and replenishing amount, the amount of said compound eluted into the washless stabilizing amount reaches the same level as that in case that said compound is directly added to the washless stabilizing solution.

In case that said compound is directly added to the washless stabilizing solution, the above treating time and the replenishing amount of the processing solution are indifferent matters. Such a mode is desirable in viewpoints of environmental prospection and process rapidity.

Next, description of the triazinylstilbene optical brightening agent used in the invention is given.

As triazinylstilbene optical brightening agents used in the invention, compounds represented by the following formula are preferable:

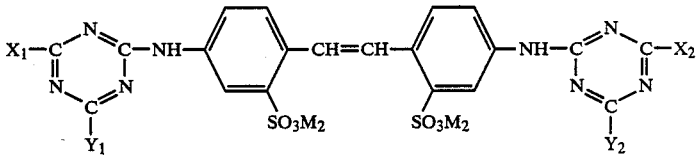

In this formula, each of $X_1$, $X_2$, $Y_1$ and $Y_2$ is a halogen atom such as chlorine or bromine; or a hydroxy, morpholino; alkoxy such as methoxy, ethoxy, or methoxyethoxy; aryloxy such as phenoxy, or p-sulfophenoxy; alkyl such as methyl or ethyl; aryl such as phenyl, or methoxyphenyl; amino; alkylamino such as methylamino, ethylamino, propylamino, dimethylamino, cyclohexylamino, β- hydroxyethylamino, di(β- hydroxyethyl)amino, β- sulfoethylamino, N-(β- sulfoethyl)-N'-methylamino, or N-(β-hydroxyethyl)-N'-methylamino; or arylamino such as anilino, o-, m-, or p-sulfoanilino, o-, m-, or p-chloroanilino, o-, m-, or p-toluidino, o-, m-, or p-carboxyamino, o-, m-, or p-hydroxyanilino, sulfonaphtylamino, o-, m-, or p-aminoanilino, or o-, m-, or p-anisidino group. M is a cation such as sodium, potassium, or ammonium.

Typical compounds represented by the above general formula are shown as follows, but the invention is not limited to them:

(E-1

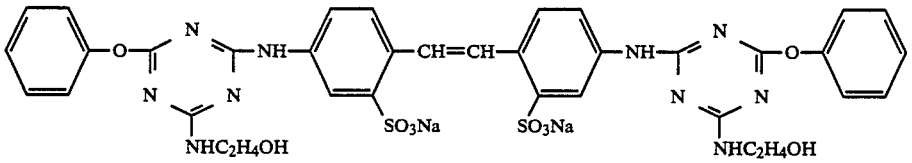

λ max = 437 nm (E-

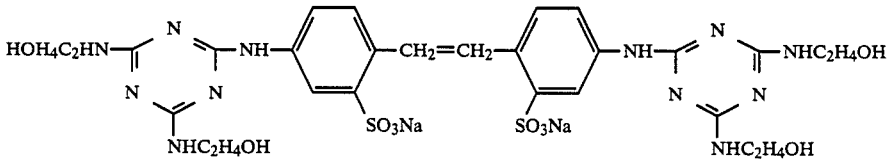

λ max = 437 nm (E-

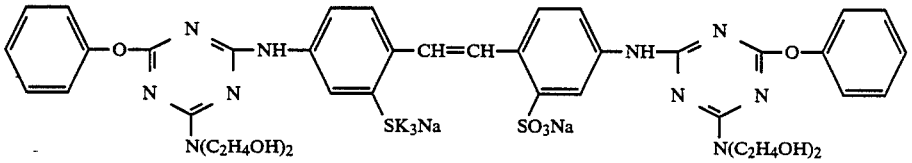

λ max = 437 nm (E-

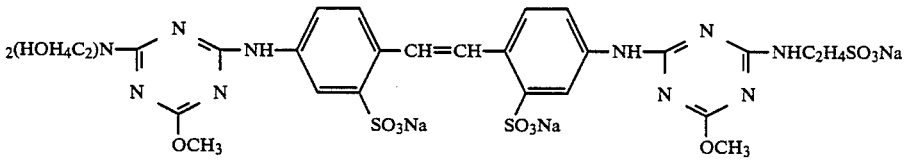

λ max = 436 nm (E-

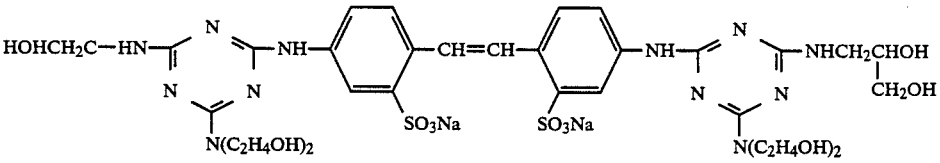

λ max = 440 nm (E-

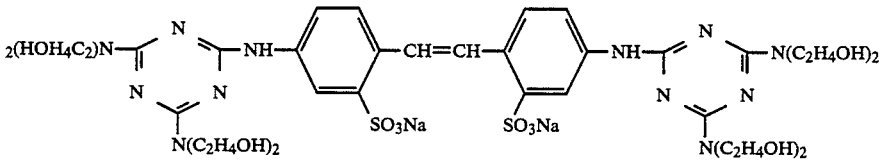

λ max = 442 nm

-continued
(E-7)
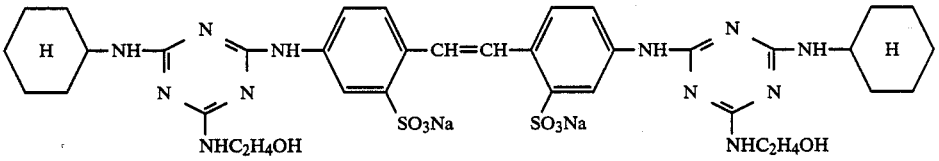
λ max = 437 nm
(E-8)
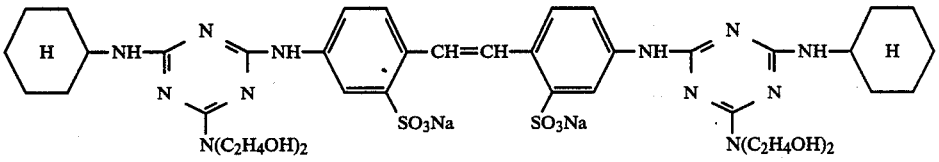
λ max = 440 nm
(E-9)
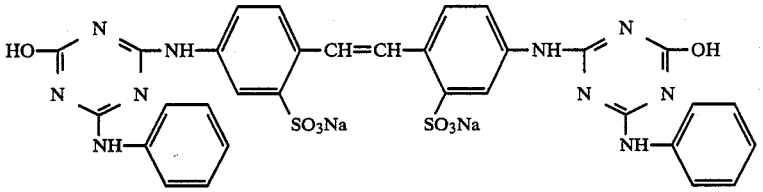
λ max = 436 nm
(E-10)
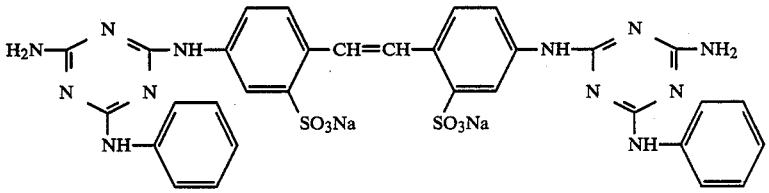
λ max = 437 nm
(E-11)
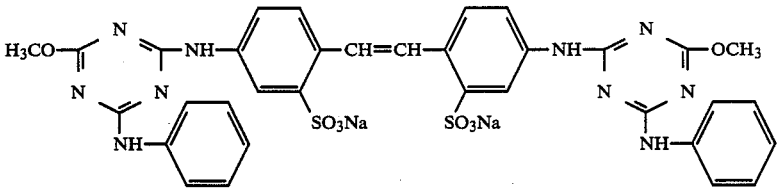
λ max = 439 nm
(E-12)
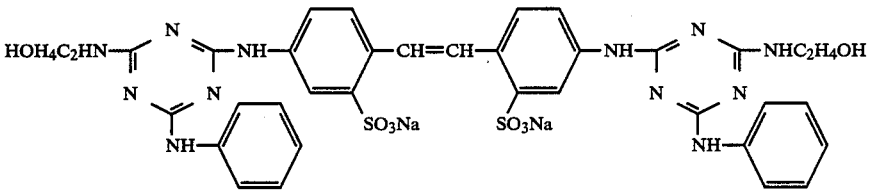
λ max = 440 nm -continued
(E-13)
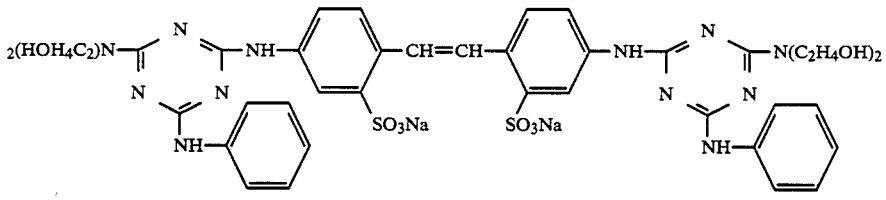
λ max = 442 nm
(E-14)
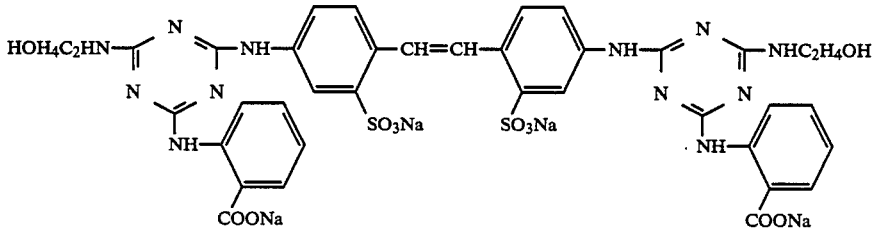
λ max = 440 nm
(E-15)
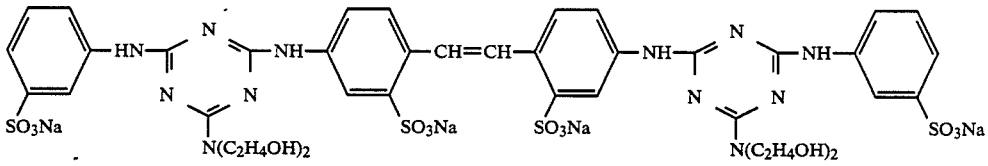
λ max = 441 nm
(E-16)
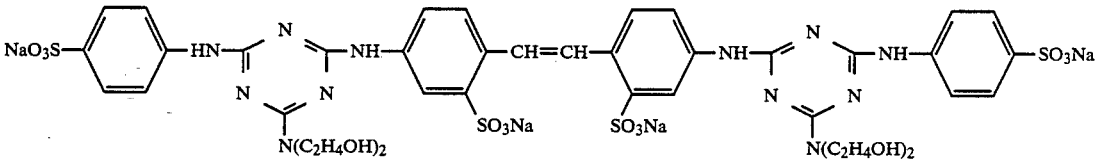
λ max = 440 nm
(E-17)
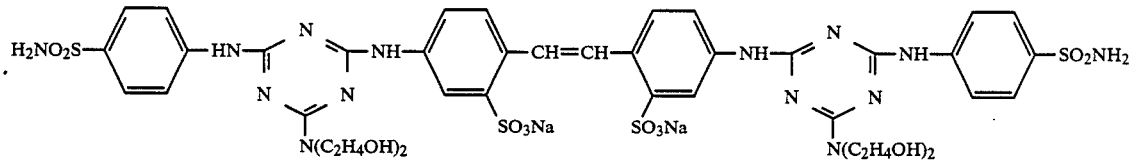
λ max = 439 nm
(E-18)
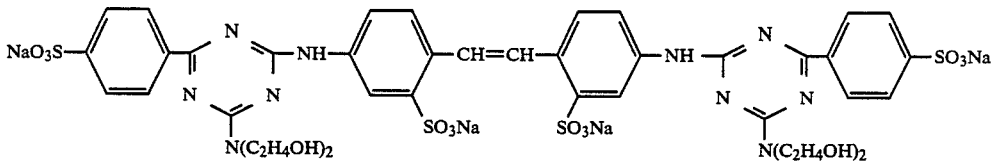
λ max = 434 nm
(E-19)
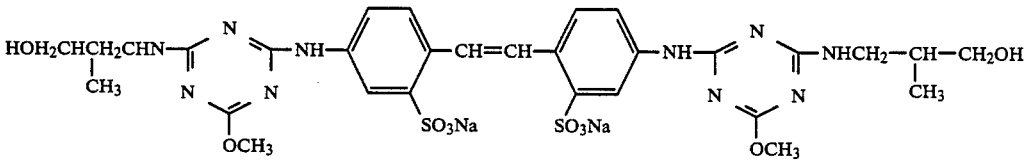
λ max = 436 nm -continued
(E-20)
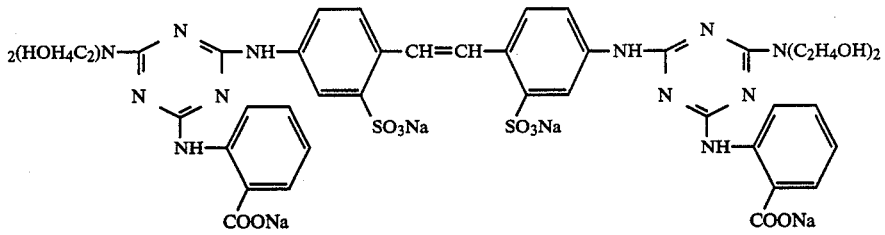
λ max = 442 nm
(E-21)
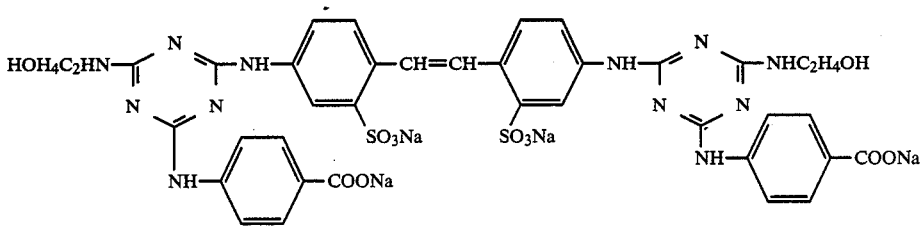
λ max = 440 nm
(E-22)
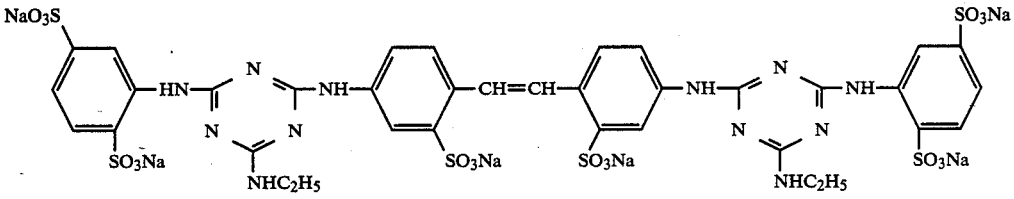
λ max = 441 nm
(E-23)
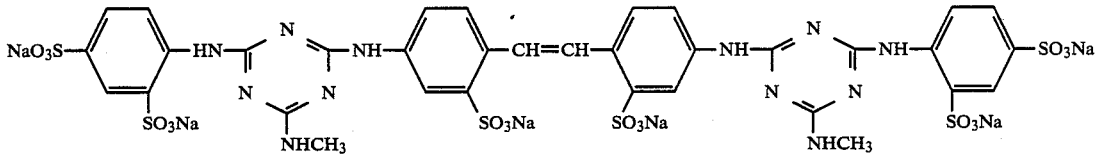
λ max = 440 nm
(E-24)
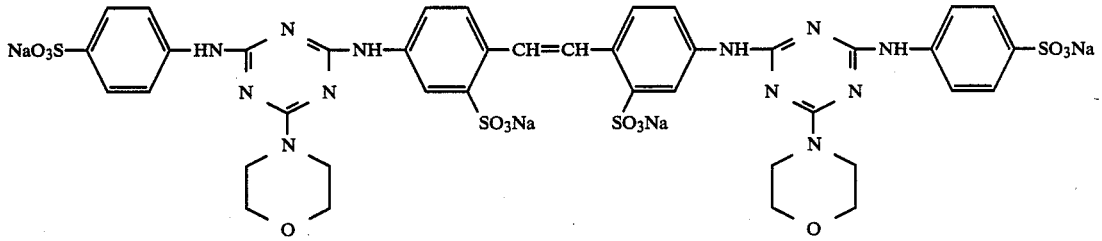
λ max = 436 nm -continued
(E-25)
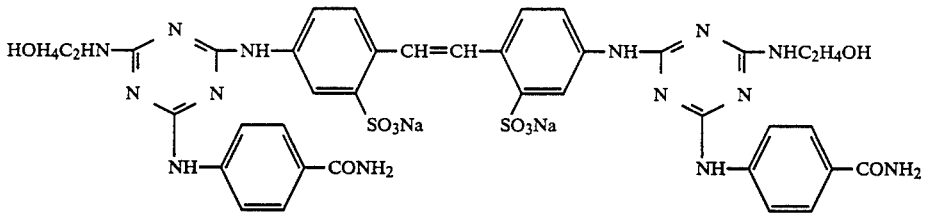
λ max = 441 nm
(E-26)
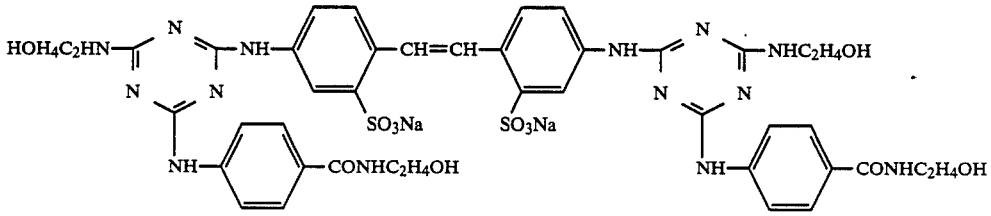
λ max = 442 nm
(E-27)
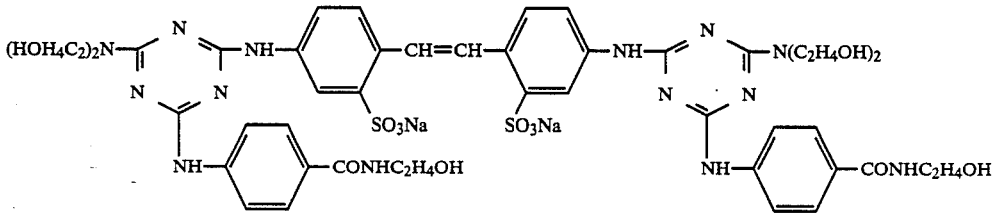
λ max = 444 nm
(E-28)
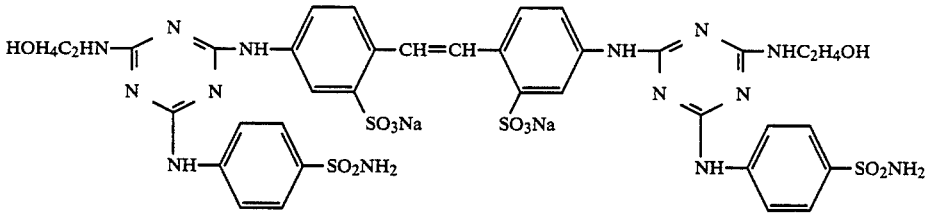
λ max = 441 nm
(E-29)
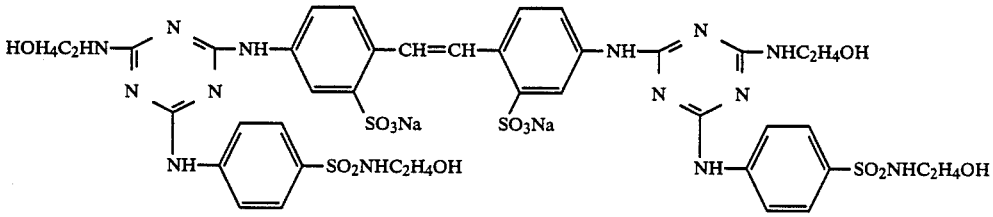
λ max = 442 nm -continued (E-30)

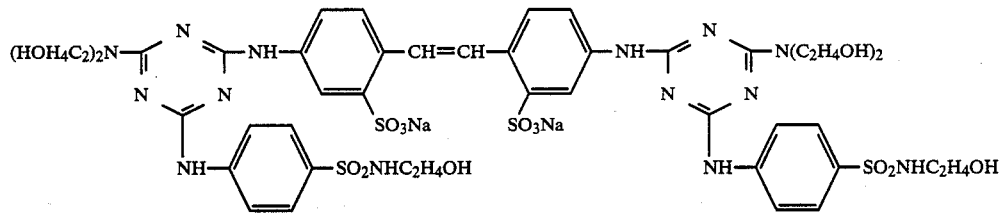

λ max = 444 nm (E-31)

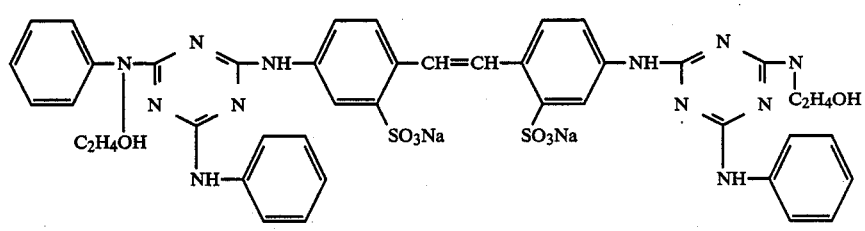

λ max = 443 nm (E-32)

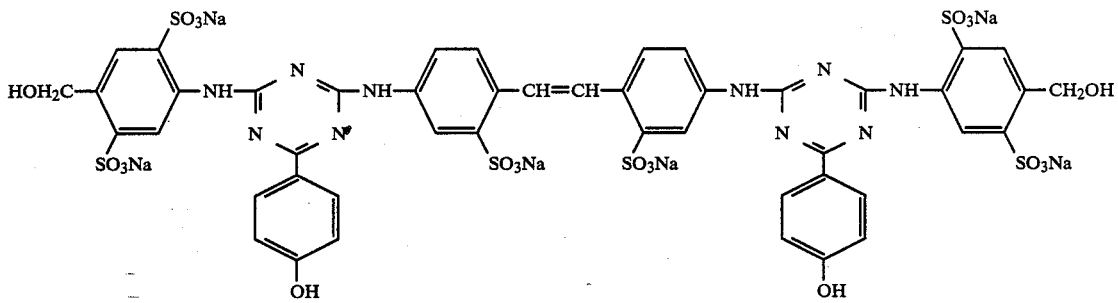

λ max = 440 nm (E-33)

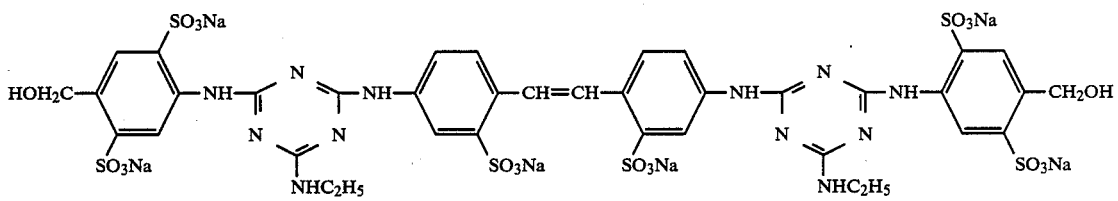

λ max = 441 nm

A triazinylstilbene optical brightening agent used in the invention can be synthesized by usual ways described in "Fluorescent Whitening Agents" (Ed: Kaseihin Kogyo Kyokai, Japan; August 1976), p.8, for example.

A triazinylstilbene optical brightening agent used in the invention attains the objects of the invention especially effectively when the fluorescent absorption maximum $\lambda_{max}$ of its fluorescent spectra is at 433 to 440 nm.

Such a triazinylstilbene optical brightening agent is added to said washless stabilizing solution preferably at a rate ranging from 0.05 g to 100 g, especially from 0.1 g to 20 g, and most desirably from 0.2 g to 10 g per liter of said stabilizing solution.

It is desirable in the invention that the triazinylstilbene optical brightening agent is contained also by the color developing bath, bleach-fixing bath, and fixing bath which all are followed by the washless stabilizing bath. It is especially desirable that it is added to the color developing bath at a rate ranging from 0.2 g to 10 g per liter of the color developer. Supposedly, this mode is effective to promote the adsorption of the aforementioned colored components onto the photosensitive material in the washless stabilizing solution.

In order to attain the objects of the invention especially effectively, the washless stabilizing solution has its pH ranging preferably from 3.0 to 11.0, especially from 6.0 to 11.0, and most desirably from 7.0 to 10.0. As for a pH adjusting agent to be added to the washless stabilizing solution in the invention, any commonly known acid or alkaline agent is applicable.

The washless stabilizing solution in the invention may also contain organic salts such as citrates, acetates, oxalates, and benzoates; pH adjusting agents such as phosphates, borates, chlorides, and sulfates; antifungal agents such as phenol derivatives, catechol derivatives, imidazole derivatives, triazole derivatives, thiabendazole derivatives, and organic chlorine compounds, and other antifungal agents known as slime controlling agents in the pulp and paper industry; metal-sequestering agents; surfactants; antiseptic preservatives, and metallic salts such as Bi, Mg, Zn, Ni, Al, Sn, Ti and Zr salts. Any of these compounds is allowed to be added to the washless stabilizing solution at any rate in any combination with each other provided that it is necessary for sustaining pH in the washless stabilizing bath, and that it does not adversely affect the preservative stability of the color photographic image and the prevention of the occurrence of precipitate in the stabilizing bath.

The stabilizing process is to be carried out at temperatures ranging from 15° C. to 60° C., preferably from 20° C. to 45° C. It is also to be carried out within a time as short as possible in terms of the advantage of rapid treatment, usually from ⅓ to 10 minutes, preferably from 1 to 3 minutes. In case of the stabilizing process in a multi-bath system, it is desirable that the treating time in every bath is increased step by step from the front through the final; it is especially desirable that every bath takes time 20 to 50% more than its preceding bath. Although, no washing process is in general necessary after the washless stabilizing process in the invention, a rinsing or surface washing process with a small amount of water within a very short time is allowed arbitrarily if necessary.

In case of a multi-bath countercurrent system, the washless stabilizing solution is preferably supplied into the final bath and allowed to overflow the front bath. As a matter of course, the stabilizing process is also allowably carried out even in a single bath system. The above compound is allowed to be added by directly putting in the stabilizing bath in the form of its concentrated solution, by putting in the supplying reservoir of the stabilizing solution together with other additives to make the washless stabilizing replenisher, or by any other appropriate procedure.

In the invention, the process of treating with a processing solution which has a fixing ability after color development, means the process carried out with use of a fixing bath or a bleach-fixing bath for the purpose of fixing the photosensitive material after the treatment with a usual color developer. Thus in the invention, the problems involved in the washless stabilizing solution to be used after the treatment in the fixing or bleach-fixing bath are resolved. Detailed description of said color developer, fixer and bleach-fixer is given later.

In the invention, the wording, "the photosensitive material is treated with a processing solution which has a fixing ability, and then not washed substantially, but treated with a washless stabilizing solution", means that the treatment with the washless stabilizing solution is immediately after the treatment in the fixing or bleach-fixing bath, and such a procedure is entirely different from the conventionally known procedure in which the photosensitive material is treated in a fixing or bleach-fixing bath, and washed, and then treated with a stabilizing solution.

Thus, the treatment with the washless stabilizing solution in the invention is referred to that, after the treatment with a processing solution which has a fixing ability, the photosensitive material is not submitted to any substantial washing treatment, but immediately to the stabilizing treatment with the washless stabilizing solution. The processing solution and the processing vessel used for said stabilizing treatment are referred to as the washless stabilizing solution and the stabilizing bath or stabilizing vessel, respectively.

In the invention, said stabilizing vessel is generally allowed to be constituted by one (1) to 5 baths, preferably of one (1) to 3 baths, at most less than 9 baths in viewpoint of the effectiveness of the invention. As for a given amount of the stabilizing replenisher, the more the baths are there, the less the concentration of contaminating components in the final stabilizing bath comes out, resulting in the weaker effects of the invention.

The washless stabilizing solution in the invention may be an aqueous solution containing the only triazinylstilbene optical brightening agent as a solute, when the photosensitive material to be treated with said solution contains at least one compound represented by General Formula [I], [II], [II'], or [II''] in the invention; and it is to be an aqueous solution which contains only both at least one compound represented by General Formula [I], [II], [II'], or [II''], and said triazinylstilbene optical brightening agent as solutes, when the photosensitive material to be treated with said solution does not contain such a compound. The washing treatment with such an aqueous solution in such a mode after a fixing treatment is included in the treatment with a washless stabilizing solution of the invention.

The photosensitive material to be submitted to the processing of the invention is a material which is made by applying silver halide emulsion layers and nonphotosensitive layers (nonemulsion layers) onto a support material. Said silver halide emulsions is allowed to be made with use of any of silver halides including silver chloride, silver bromide, silver iodide, silver chlorobromide, silver chloroiodide, silver iodobromide, and silver chloroiodobromide. The above emulsion layers and nonphotosensitive layers are allowed to appropriately contain couplers and additives known in the field of photography, yellow dye-forming couplers, magenta dye-forming couplers, cyan dye-forming couplers, stabilizers, sensitizing dyes, gold compounds, high-boiling organic solvents, antifoggants, color image antifading agents, anti-color staining agents, optical brightening agents, antistatic agents, hardeners, surfactants, plasticizers, wetting agents and UV absorbing agents, for example.

The photosensitive material is manufactured by applying constituent layers, including emulsion layers and nonphotosensitive layers, which contain the above various photographic additives as necessary onto a support material which has preliminarily been treated with corona discharge, flame exposure, or UV irradiation, directly or through the medium of a primer coating, or an intermediate layer.

As for support materials advantageously used for the invention, there are cited baryta paper, polyethylene-coated paper, polypropylene synthetic paper, and transparent bases having a reflective layer or combined with a reflecting matter, such as glass plate, cellulose acetate film, cellulose nitrate film, polyester film (for example polyethylene terephthalate film), polyamide film, polycarbonate film, and polystyrene film, for example.

Each of most silver halide emulsion layers and nonphotosensitive layers of the photosensitive material usually poses a hydrophilic colloidal layer having a hydrophilic binder. As said hydrophilic binder, there is preferably used gelatin, or a gelatin derivative such as acylated gelatin, guanidylated gelatin, phenylcarbamylated gelatin, phthalated gelatin, cyanoethanolated gelatin, or esterified gelatin.

As such a hardener to make the hydrophilic colloidal layer hardened, there are useful for example, chromates such as chrome alum, and a chromic acetate; aldehydes such as formaldehyde, glyoxal, and glutaraldehyde; N-methylol compounds such as dimethylolurea, and methylol dimethylhydantoin; dioxane derivatives such as 2,3-dihydroxydioxane; active vinyl compounds such as 1,3,5-triacryloyl-hexahydro-s-triazine, and 1,3-vinylsulfonyl-2-propanol); active halogen compounds such as 2,4-dichloro-6-hydroxy-s-triazine); and mucohaloacids such as mucochloric acid, and mucophenoxychloric acid in the single use or combined use with each other.

The method of the invention is particularly effective when total dry film thickness of the emulsion layers plus the nonphotosensitive layers ranges from 5 to 20 μm, more especially from 5 to 15 μm.

The effects of the invention are especially effectively exhibited when the photosensitive material is of "oil-protective type", that is, has the couplers which are contained dispersively in a high-boiling organic solvent. As such a high-boiling organic solvent, there are useful, for example, organic amides, carbamates, esters, ketones, and urea derivatives; especially among them, phthalic esters such as dimethyl phthalate, diethyl phthalate, dipropyl phthalate, dibutyl phthalate, di-n-octyl phthalate, diisooctyl phthalate, diamyl phthalate, dinonyl phthalate, and diisodecyl phthalate; phosphoric esters such as tricresyl phosphate, triphenyl phosphate, tri(2-ethylhexyl) phosphate, and trinonyl phosphate; sebacic esters such as dioctyl sebacate, di(2-ethylhexyl) sebacate, and diisodecyl sebacate; glycerides such as glycerol tripropionate, and glycerol tributyrate; other aliphatic esters such as adipates, glutarate, succinates, maleates, fumarates, and citrates; or phenolic derivatives such as di-tert-aminophenol and n-octylphenol.

In the color developing process of the invention, there are used aromatic primary amine developing agents, including various known compounds which are widely used in various color photographic processes. These developing agents include aminophenol derivatives and p-phenylenediamine derivatives, which are used in the form of salt such as hydrochloride or sulfate rather than free amine because of higher stability of salt. These compounds are usually used at a concentration ranging from about 0.1 g to about 30 g, preferably from about 1.0 g to about 1.5 g per liter of color developer.

The aminophenol developer used in the invention is o-aminophenol, p-aminophenol, 5-amino-2-oxytoluene, 2-amino-3-oxytoluene, or 2-oxy-3-amino-1,4-dimethylbenzene, for example.

The particularly useful aromatic primary amines are N,N'-dialkyl-p-phenylenediamine compounds, whose alkyl and/or phenyl group is allowed to be substituted with an arbitrary substituent group. Among these compounds, there are cited, N,N'-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino) toluene, N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, and 4-amino-N-(2-methoxyethyl)-N-ethyl-3-methylaniline-p-toluene sulfonate.

The developer of the invention is allowed to arbitarily contain, besides the above aromatic primary amine color developing agents, various components, which are usually added to color developers, including alkali agents such as sodium hydroxide, sodium carbonate and potassium carbonate; alkali metal thiocyanates, alkali metal halides, benzyl alcohol, water softening agents, and thickening agents, for example. The color developer in which aromatic primary amine color developing agents are used as color developing agents has its pH larger than 7, most generally ranging from about 10 to about 13.

As a fixing agent used in the fixer which has a fixing ability in the invention, there are useful thiosulfates (described in Japanese Patent O.P.I. Publication No. 185435/1982), thiocyanates (described in the specification of British Pat. No. 565135, and in Japanese Patent O.P.I. Publication No. 137143/1979), halides (described in Japanese Patent O.P.I. Publication No. 130639/1977); thioethers (described in the specification of Belgian Pat. No. 626970), and thioureas (described in the specification of British Pat. No. 1189416), for example. In particular among them, thiosulfates prominently exhibit the effects of the invention, especially in case that said processing solution which has a fixing ability is a bleach-fixer, and, as said bleaching agent, there are useful ferric complex salts of organic acids (described in Japanese Patent Examined Publication Nos. 38895/1979 (which corresponds to U.S. Pat. No. 4,033,771) and 500704/1980, and in Japanese Patent O.P.I. Publication Nos. 52748/1981 and 149385/1984).

In case that said processing solution, which has a fixing ability, is a processing solution for the purpose of the only fixing treatment, any type of bleaching agents can be used in the bleaching treatment preceding said fixing treatment, including potassium ferricyanide, ferric chloride (described in the specification of British Pat. No. 736881, and in Japanese Patent Examined Publication No. 44424/1981), persulfuric acid (described in the specification of West German Pat. No. 2141199), hydrogen peroxide (described in Japanese Patent Examined Publication Nos. 11617/1983 (which corresponds to U.S. Pat. No. 4,277,556) and 11618/1983), and ferric complex salts of organic acids (described in Japanese Patent O.P.I. Publication Nos. 70533/1982 and 43454/1983, and in the specification of Japanese patent application No. 40633/1983).

Silver is allowed to be recovered not only from the washless stabilizing solution but also from the processing solution such as the fixer and/or the bleach-fixer which contains soluble silver complex salts with an effective use of a commonly known method such as an electrolytic procedure (described in French Patent Publication No. 2,299,667), a precipitating procedure (described in Japanese Patent O.P.I. Publication No. 73037/1977, and in the specification of West German Pat. No. 2,331,220), an ion exchanging procedure (described in Japanese Patent O.P.I. Publication No. 17114/1976, and in the specification of West German Pat. No. 2,548,237), or a metal exchanging procedure (described in the specification of British Pat. No. 1,353,805), for example.

The processing method of the invention is advantageous when applied for treating color negative paper, color positive paper, and reversal color paper. It is particularly effective when applied in the following process:

(1) a process composed of color developing, and bleach-fixing through washless stabilizing procedures; and (2) a process composed of color developing, bleaching, and fixing through washless stabilizing procedures.

EXAMPLES

Definite description of the invention is given based on substantial examples as follows, but the mode of practice of the invention is not limited thereto.

EXAMPLE 1

A series of experiments were made using the following color paper and processing solutions according to the following processing conditions:

Color Paper:

Layers described below were coated on a support material of polyethylene-coated paper in the order described, to make a photosensitive material.

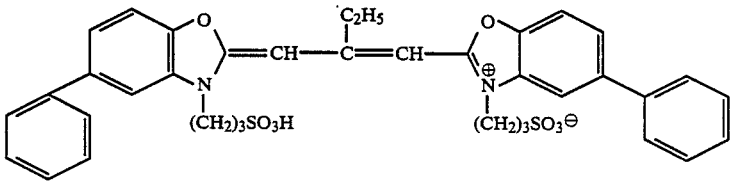

The above polyethylene-coated paper was a piece of 170 g/m$^2$ fabricated free sheet had been made through the following procedures: (1) A mixture of 200 wt. parts of polyethylene having an average molecular weight of 100,000 and a density of 0.95; and 20 wt. parts of polyethylene having an average molecular weight of 2000 and a density of 0.80 with 6.8 wt. % of anatase-type titanium dioxide, is applied to cover the paper by an extrusion-coating process to form a surface covering layer 0.035 mm thick, and then (2) the same polyethylene mixture without titanium dioxide is applied onto the backside of the paper similarly to form a back covering layer 0.040 mm thick. Then, (3) the surface covering polyethylene layer is pretreated with corona irradiation, and then applied onto with the layers abovementioned as follows.

First Layer:

The first layer is a blue-sensitive silver halide emulsion layer composed of a silver chlorobromide emulsion having a silver bromide content of 80 mole %. Said emulsion contains 350 g of gelatin per mole of silver halide, is sensitized by $2.5\times10^{-3}$ moles (per mole of silver halide) of a sensitizing dye represented by the following formula:

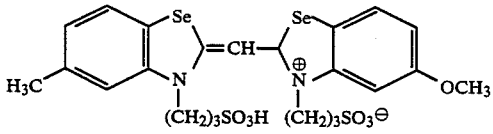

with the use of isopropyl alcohol as a solvent; and contains a dispersed solution (in dibutyl phthalate) of both 200 mg/m$^2$ of 2,5-di-tert-butyl hydroquinone, and $2\times10^{-1}$ moles (per mole of silver halide) of α-[4-(1-benzyl-2-phenyl-3,5-dioxo-1,2,4-triazolidyl)]-α-pivalyl-2-chloro-5-[γ-(2,4-di-tert-amylphenoxy) butylamido] acetanilide as a yellow coupler, and then coated at a rate of 330 mg of silver per m$^2$ of the photosensitive material.

Second Layer:

The second layer is a gelatin layer which has 2000 mg of gelatin per m$^2$ of the photosensitive material, and is formed by coating a dispersed solution (in dibutyl phthalate) of 300 mg/m$^2$ of di-tert-octylhydroquinone, and 200 mg/m$^2$ of the mixture of 2-(2'-hydroxy-3',5'-di-tert-butylphenyl) benzotriazole, 2-(2'-hydroxy-5'-tert-butyl-phenyl) benzotriazole, 2-(2'-hydroxy-3'-tert-butyl-5'-methylphenyl)-5-chlorobenzotriazole, and 2-(2'-hydroxy-3',5'-di-tert-butylphenyl)-5-chlorobenzotriazole as UV absorbers.

Third Layer:

The third layer is a green-sensitive silver halide emulsion layer composed of a silver chlorobromide emulsion having a silver bromide content of 85 mole %. Said emulsion contains 450 g of gelatin per mole of silver halide, is sensitized by $2.5\times10^{-3}$ moles (per mole of silver halide) of a sensitizing dye represented by the following formula:

and contains a dispersed solution [in a solvent composed of dibutyl phthalate and tricresyl phthalate (2:1)] of 150 mg/m$^2$ of 2,5-di-tert-butylhydroquinone, and 1-(2,4,6-trichlorophenyl)-3-(2-chloro-5-octadecenylsuccinimidoanilino)-5-pyrazolone (as a magenta coupler; $1.5\times10^{-1}$ moles per mole of silver halide); and then coated at a rate of 300 mg of silver per m$^2$ of the photosensitive material. In addition, 2,2,4-trimethyl-6-lauryloxy-7-tert-octylcoumarone is added into as an antioxidant at a rate of 0.3 moles per mole of the coupler.

Fourth Layer:

The fourth layer is a gelatin layer which has 2000 mg of gelatin per m$^2$ of the photosensitive material, and contains a dispersed solution (in dibutyl phthalate) of 30 mg/m$^2$ of di-tert-octylhydroquinone, and 500 mg/m$^2$ of a mixture of 2-(2'-hydroxy-3',5'-di-tert-butylphenyl) benzotriazole, 2-(2'-hydroxy-5'-tert-butylphenyl) benzotriazole, 2-(2'-hydroxy-3'-tert-butyl-5'-methylphenyl)-5-chlorobenzotriazole, and 2-(2'-hydroxy-3',5'-tert-butylphenyl)-5-chlorobenzotriazole (2:1.5:1.5:2, as UV absorbers).

Fifth Layer:

The fifth layer is a red-sensitive silver halide emulsion layer composed of a silver chlorobromide emulsion having a silver bromide content of 85 mole %. Said emulsion contains 500 g of gelatin per mole of silver halide; is sensitized by $2.5\times10^{-3}$ moles of a sensitizing dye represented by the following formula:

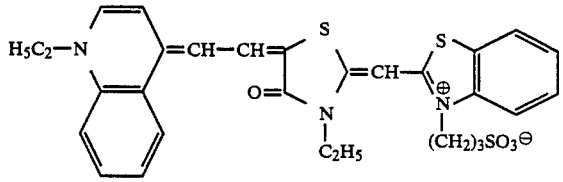

and contains a dispersed solution (in dibutyl phthalate) of both 2,5-di-tert-butylhydroquinone (mg/m$^2$), and 2,4-dichloro-3-methyl-6-[γ-(2,4-diamylphenoxy)-butylamido)-phenol (as a cyan coupler; $3.5\times10^{-1}$ moles per mole of silver halide); and then coated at a rate 300 mg of silver per $m^2$ of photosensitive material.

Sixth Layer:

The sixth layer is a gelatin layer which has 1000 mg of gelatin per $m^2$ of photosensitive material.

Each of silver halide emulsions used in the first, third and fifth photosensitive emulsion layers was prepared according to the method described in Japanese Patent Examined Publication No. 7772/1971, chemically sensitized with use of sodium thiosulfate pentahydrate, and added to with 4-hydroxy-6-methyl-1,3,3*a*,7-tetrazaindene as a stabilizer, bis(vinylsulfonylmethyl) ether as a hardener, and saponin as a coating aid.

The thickness of the film prepared according to the above applying procedures and dried was 13 μm.

The color paper prepared according to the above procedures was exposed to light, and then continuously treated with the following processing solutions under the following conditions:

| Standard Processing Conditions: | | |
|---|---|---|
| Color developing: | 38° C. | 3½ minutes |
| Bleach-fixing: | 33° C. | 1½ minutes |
| Stabilizing: | 25–35° C. | 3 minutes |
| Drying: | 65–75° C. | ca. 2 minutes |
| Composition of Processing Solutions: | | |
| (Color Developer in Tank) | | |
| Benzyl alcohol | | 15 ml |
| Ethylene glycol | | 15 ml |
| Potassium sulfite | | 2.0 g |
| Potassium bromide | | 1.3 g |
| Sodium chloride | | 0.2 g |
| Potassium carbonate | | 30.0 g |
| 3-Methyl-4-amino-N—ethyl-N—(β-methanesulfonamidoethyl)aniline sulfate | | 5.5 g |
| E-33, Exemplified Compound | | 1.0 g |
| Hydroxylamine sulfate | | 3.0 g |
| 1-Hydroxyethylindene-1,1-diphosphonic acid | | 0.4 g |
| Hydroxyethyliminodiacetic acid | | 5.0 g |
| Magnesium chloride, hexahydrous | | 0.7 g |
| 1,2-Dihydroxybenzene-3,5-disulfonic acid, disodium salt | | 0.2 g |
| Water to make | | one (1) liter |
| KOH or $H_2SO_4$ to make pH | | 10.20 |
| (Color Developer Replenisher) | | |
| Benzyl alcohol | | 20.0 ml |
| Ethylene glycol | | 15.0 ml |
| Potassium sulfite | | 3.0 g |
| Potassium carbonate | | 30.0 g |
| Hydroxylamine sulfate | | 4.0 g |
| 3-Methyl-4-amino-N—ethyl-N—(β-methanesulfonamidoethyl)aniline sulfate | | 7.5 g |
| E-33, Exemplified Compound | | 2.5 g |
| 1-Hydroxyethylidene-1,1-diphosphonic acid | | 0.5 g |
| Hydroxyethyliminodiacetic acid | | 5.0 g |
| Magnesium chloride, hexahydrous | | 0.8 g |
| 1,2-Dihydroxybenzene-3,5-disulfonic acid, disodium salt | | 0.3 g |
| Water to make | | one (1) liter |
| KOH to make pH | | 10.70 |
| (Bleach-Fixer in Tank) | | |
| Ferric ammonium ethylenediamine-tetraacetate, dihydrous | | 60 g |
| Ethylenediaminetetraacetic acid | | 3 g |
| Ammonium thiosulfate, 70% solution | | 100 ml |
| Ammonium sulfite, 40% solution | | 27.5 ml |
| Water to make | | one (1) liter |
| Potassium carbonate or glacial acetic acid to make pH | | 7.1 |
| (Bleach-Fixer Replenisher A) | | |
| Ferric ammonium ethylenediamine-tetraacetate | | 260 g |
| Potassium carbonate | | 420 g |

-continued

| | |
|---|---|
| Water to make | one (1) liter |
| (pH to be 6.7 ± 0.1) | |
| (Bleach-Fixer Replenisher B) | |
| Ammonium thiosulfate, 70% solution | 500 ml |
| Ammonium sulfite, 40% solution | 250 ml |
| Ethylenediaminetetraacetic acid | 17 g |
| Glacial acetic acid | 85 ml |
| Water to make | one (1) liter |
| (pH to be 5.3 ± 0.1) | |
| (Washless Stabilizing Solution in Tank and its Replenisher) | |
| 5-Chloro-2-methyl-4-isothiazolin-3-one | 0.02 g |
| 2-Methyl-4-isothiazolin-3-one | 0.02 g |
| Ethylene glycol | 1.0 g |
| 2-Octyl-4-isothiazolin-3-one | 0.01 g |
| 1-Hydroxyethylidene-1,1-diphosphonic acid, 60% aqueous solution | 3.0 g |
| Bismuth trichloride, 45% aqueous solution | 0.65 g |
| Trisodium nitrilotriacetate | 1.5 g |
| Water to make | one (1) liter |
| $H_2SO_4$ and KOH to make pH | 7.0 |

An automatic developing equipment was filled with the above color developer (in tank), bleach-fixer (in tank), and stabilizing solution (in tank). A running test was carried out by that, while the color paper was processed, the above color developer replenisher, bleach-fixer replenishers A and B, and stabilizing solution replenisher were added every 3 minutes with use of measuring cups. The color developer replenisher was replenished to the color developing tank at a rate of 190 ml per $m^2$ of color paper. Each of bleach-fixer replenishers A and B was replenished to the bleach-fixing tank at a rate of 50 ml per $m^2$. The washless stabilizing solution replenisher was replenished to the stabilizing bath at a rate of 250 ml per $m^2$.

The series of stabilizing baths of said automatic developing equipment were composed of the first (front) bath through the third (final) bath along the moving direction of the photosensitive material, and the stabilizing solution replenisher supplied to the final bath was allowed to overflow into the second (intermediate) bath, and so forth to transfer countercurrently against the motion of the photosensitive material.

Thus the continuous processing was conducted until the total of replenishing washless stabilizing solution amounted to 10 times the capacity of the stabilizing tank. Thereafter, seven one (1)-liter samples were collected from the washless stabilizer solution of each of the first to third baths, added to with the compounds shown in Table 1, respectively, and then the pH of each sample was adjusted to 7.5 with $H_2SO_4$ or KOH. The photosensitive material previously prepared through the aforementioned processes with the aforementioned processors, was treated with the processing solution which had been used in the continuous processing. Besides them, samples were prepared as reference (No. 10 in Table 1) by treating with flowing water instead of the washless stabilizing solution.

The white ground of unexposed areas of obtained samples was observed visually. The spectral reflectance density of the white ground of unexposed areas of each sample at 440 nm was determined with a color analyser (made by Hitachi, Ltd.)

A 300-hour light fading test by a xenon arc lamp was carried out on magenta color developed areas of each treated sample, and the dye image densities of green light before and after the fading test were determined with an optical densitometer (Konishiroku, Model PDA-65), and the fading rate was obtained therefrom. These results are shown in Table 2.

TABLE 1

| Sample No. | Added compound | |
|---|---|---|
| 1 | None | |
| 2 | 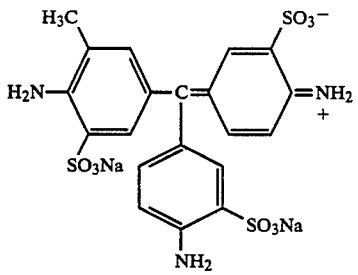 | 5 mg/l |
| | Exempl. (E-18) | 1.0 g/l |
| 3 | Exempl. (E-18) | 1.0 g/l |
| 4 | Exempl. (B-20) | 5.0 mg/l |
| 5 | Exempl. (B-20) | 5.0 mg/l |
| | Exempl. (E-33) | 1.0 g/l |
| 6 | Exempl. (B-20) | 5.0 mg/l |
| | Exempl. (E-18) | 1.0 g/l |
| 7 | Exempl. (B-22) | 5.0 mg/l |
| | Exempl. (A-1) | 5.0 mg/l |
| | Exempl. (E-18) | 1.0 g/l |
| 8 | Exempl. (C-7) | 5.0 mg/l |
| | Exempl. (E-18) | 1.0 g/l |
| 9 | Exempl. (D-8) | 5.0 mg/l |
| | Exempl. (E-18) | 1.0 g/l |

TABLE 2

| Sample No. | Visual observation of white ground[a] | Spectral reflectance density (440 nm) | Light-fading rate (magenta dye) | Remark[b] |
|---|---|---|---|---|
| 1 | x | 0.132 | 29 | Ref. |
| 2 | x | 0.130 | 29 | Ref. |
| 3 | x | 0.130 | 28 | Ref. |
| 4 | x | 0.129 | 28 | Ref. |
| 5 | o | 0.104 | 22 | Inv. |
| 6 | oo | 0.098 | 20 | Inv. |
| 7 | oo | 0.094 | 19 | Inv. |
| 8 | o | 0.107 | 23 | Inv. |
| 9 | o | 0.107 | 22 | Inv. |
| 10 | o | 0.101 | 21 | Ref.[c] |

(Note)
[a]White ground compared with the wash-treated: x: grayish to yellowish, o: similar, oo: whiter.
[b]Ref.: reference, Inv. invention (See Table 1).
[c]Washed with flowing water.

It can be seen from Table 2 that, photosensitive materials (Sample Nos. 1 to 4) processed with the use of a compound known as a photographic dye, other than those of the invention, or of the only either of 2 groups of compounds of the invention, are inferior in visual observation of white ground of unexposed areas, higher in optical reflectance density, and less effective in prevention of staining and light fading, compared with the one processed with flowing water (sample No. 10). On the contrary, it proves that photosensitive materials (sample Nos. 5 to 9) processed with the combined use of a triazinylstilbene optical brightening agent and a compound represented by General Formula [I], [II], [II'], or [II'']in the invention, well sustain whiteness of white ground of unexposed areas, comparable in magenta dye light fading rate to the one processed with flowing water. It proves also that samples (Nos. 6 and 7) obtained with the use of Exemplified Compound (E-18), which has its maximum wavelength $\lambda_{max}$ of fluorescent spectra of triazinylstilbene optical brightening agent at 433 to 440 nm, exhibit the effects of the invention further prominently. Furthermore, it proves also that the sample (No. 7) obtained with the combined use of Exemplified Compounds (A-1 and B-22) represented by General Formula [I], [II], [II'], or [II''], is most effective.

EXAMPLE 2

One (1) liter of 14 samples were collected from the washless stabilizing solution after the continuous processing in Example 1. Seven (7) samples of them were added to with Exemplified Compounds of the invention, and their pHs were adjusted to 2.5 to 11.5 with dilute solution of $H_2SO_4$ or KOH, according to Table 3. Remaining 7 samples were added to with no compounds, but only pH-adjusted similarly. All of pH-adjusted samples of washless stabilizer solution were treated in the same way as in Example 1, and submitted to the determination of spectral reflectance density at 440 nm. Results are shown in Table 3.

TABLE 3

| Added compound | Spectral reflectance density (440 nm) pH = 2.5 | 3.5 | 6.1 | 7.1 | 9.8 | 10.5 | 11.5 |
|---|---|---|---|---|---|---|---|
| Invention: | | | | | | | |
| (A-1) 10 mg/l (E-18) 1.0 g/l | 0.170 | .142 | .110 | .096 | .098 | .110 | .152 |
| Reference: | | | | | | | |
| None | 0.185 | .164 | .142 | .133 | .138 | .149 | .171 |

As seen in Table 3, pH of the washless stabilizing solution of the invention ranges preferably from 3.0 to 11.0, especially from 6.0 to 11.0, and most desirably from 7.0 to 11.0.

EXAMPLE 3

Samples of photosensitive material were prepared in the same way as in Example 1, except that the fifth layer was added to with 2% solution of Exemplified Compound (A-1) by 25 mg per $m^2$ of photosensitive material. Its film thickness after drying resulted in 13.2 $\mu$m. It was submitted to the same continuous processing as in Example 1 with the same conditions and processing solutions. Thereafter, it was processed with the washless stabilizing solution (in tank) and its replenisher which had been added to with 2 g per liter of Exemplified Compound (E-4) of the invention, and was pH-adjusted and then processed, as in Example 1. The white ground of the sample which was processed with the washless stabilizing solution containing Exemplified Compound (E-4) was much better in whiteness compared with the slightly grayish tint of the reference [without (E-4)].

EXAMPLE 4

Photosensitive material of Example 1, and the one of Example 3 were processed with the processing solutions equivalent to those used in the process of Example 1. The former was designated as the reference. The processing conditions (treating processes, processing solution, and the like) were the same as in Example 1, except that the washless stabilizing solution which had the below composition [containing Exemplified Compound (E-32) represented by General Formula [II''] of the invention] was used instead. The stabilizing solution after the use of continuous processing was also pH-adjusted in the same way as in Example 1. As a result, the photographic image prepared with use of the photographic material of Example 4, which contained the compound represented by General Formula [I], was much better in the spectral reflectance density of white ground, and the magenta color image light fading rate, in comparison with the photographic image prepared with use of photosensitive material not containing any compound represented by General Formula [I], [II], [II'], or [II''] of the invention.

| (Washless Stabilizing Solution in Tank and its Replenisher) | |
|---|---|
| 1-Hydroxyethylidene-1,1-diphosphonic acid | 1.5 g |
| Exemplified Compound (E-32) | 1.5 g |
| Water to make | one (1) liter |
| KOH (40% solution) to make pH | 7.8 |

EXAMPLE 5

Samples of photosensitive material were prepared in the same way as in Example 1, except that the sixth layer was applied immediately after the first layer without the second to fifth layers. And in similar ways, samples were prepared with multiplying the applying amount of the first layer 2-, 3-, 4-, 5-, 6-, and 7-fold. The resulting dry film thickness are shown as in Table 4. Each of the above unexposed photosensitive materials was processed with the processing solution once used in a continuous processing in Example 4 of the invention [whose washless stabilizing solution contained the eluted Exemplified Compound (A-1), and the optical brightening agent (E-32)], and, alternatively, with the reference processing solution, which contained the optical brightening agent (E-32), but not the Compound (A-1) at all. As to each sample, the visual observation and the spectral reflectance density at 440 nm were determined in the same way as in Example 1. Results are shown in Table 4.

TABLE 4

| Added compd. | Applied amount of 1st layer (times) | 1 | 2 | 3 | 4 | 5 | 6 | 7 |
|---|---|---|---|---|---|---|---|---|
| | Dry thickness (μm) | 4.3 | 7.1 | 10.3 | 13.5 | 16.7 | 19.8 | 23.1 |
| Invention: (A-1) in photosens. mat. (25 mg/m²) (E-32) in washless stabl. soln. (1.5 g/l) | Visual observation of white ground[a] | oo | oo | oo | oo | o | o | x |
| | Spectral reflectance density of white ground (440 nm) | 0.085 | 0.091 | 0.095 | 0.980 | 0.106 | 0.109 | 0.117 |
| Reference: None in photosens. mat. (E-32) in washless stabl. soln. (1.5 g/l) | Visual observation of white ground[a] | oo | x | x | x | x | x | x |
| | Spectral reflectance density of white ground (440 nm) | 0.098 | 0.126 | 0.131 | 0.134 | 0.137 | 0.139 | 0.141 |

(Note)
[a]See Table 1.

As seen in Table 4, the effects of the invention are especially prominent when the dry film thickness of the photosensitive material ranges from 5 to 20 μm.

What is claimed is:

1. In a processing method for silver halide color photosensitive material in which silver halide color photosensitive material is treated to produce a color dye image with a processing solution that has a fixing ability, and subsequently is not washed but treated with a washless stabilizing solution, the improvement comprising treating said silver halide color photosensitive material with a washless stabilizing solution that contains a triazinylstilbene optical brightening agent in the presence of an amount sufficient to stabilize the dye image and reduce staining of the photosensitive material of at least one compound represented by General Formula (I), (II), (II') or (II''):

General Formula [I]:

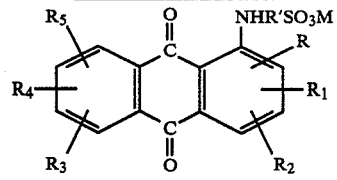

where each of R, $R_1$, $R_2$, $R_3$, $R_4$ and $R_5$ is a hydrogen or halogen atom, or a hydroxy, alkyl, alkoxy, sulfo or —NHR'$SO_3M$ group; R' is an alkylene group; and M is a cationic group;

General Formula [II]:

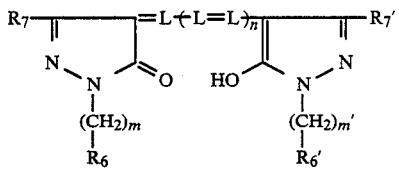

where each of $R_6$ and $R_6'$ is a hydrogen atom, or an alkyl, aryl or heterocyclic group; each of $R_7$ and $R_7'$ is a hydroxy, alkoxy, cyano, trifluoromethyl, —$COOR_8$, —$CONHR_8$, —$NHCOR_8$, ureido, imino or amino group, a $C_{1-4}$-alkyl-substituted amino group, or a cyclic amino group represented by

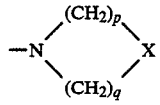

where each of p and q is the integer 1 or 2; X is an oxygen or sulfur atom, or a —$CH_2$—group; $R_8$ is a hydrogen atom, or an alkyl or aryl group; L is a methine group; n is the integer 0, 1 or 2; each of m and m' is the integer 0 or 1;

General Formula [II']:

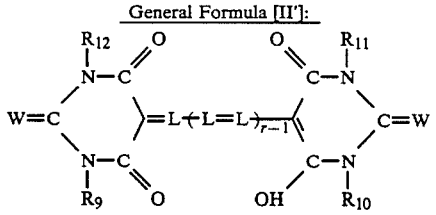

where r is the integer 1, 2 or 3; W is an oxygen or sulfur atom; L is a methine group; each of $R_9$ to $R_{12}$ is a hydrogen atom, or an alkyl, aryl, aralkyl or heterocyclic group; and at least one of $R_9$ to $R_{12}$ is a substituent group other than a hydrogen atom;

General Formula [II'']:

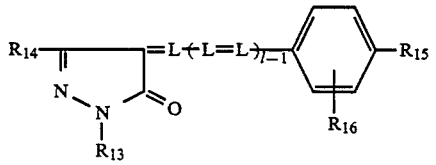

where l is the integer 1 or 2; L is a methine group; $R_{13}$ is an alkyl, aryl or heterocyclic group; each of $R_{14}$ and $R_{15}$ is a hydroxy, alkyl, alkoxy, cyano, trifluoromethyl, —$COOR_8$, —$CONHR_8$, —$NHCOR_8$, ureido, imino, amino, or a $C_{1-4}$-alkyl-substituted amino group, or a cyclic amino group; represented by

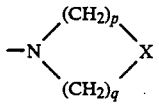

where each of p and q is the integer 1 or 2; X is an oxygen or sulfur atom, or a —$CH_2$-group); $R_8$ is a hydrogen atom, or an alkyl or aryl group; and $R_{16}$ is a hydrogen or chlorine atom, or an alkyl or alkoxy group.

2. The processing method as claimed in claim 1, characterized by that the maximum fluorescent wavelength $\lambda_{max}$ of said triazinylstilbene optical brightening agent is 433 to 440 nm.

3. The processing method as claimed in claim 1, characterized by that the washless stabilizing solution is added with said triazinylstilbene optical brightening agent in an amount of from 0.05 g to 100 g per liter of said washless stabilizing solution.

4. The processing method as claimed in claim 3, characterized by that the washless stabilizing solution is added with said triazinylstilbene optical brightening agent in an amount of from 0.1 g to 20 g per liter of said washless stabilizing solution.

5. The processing method as claimed in claim 4, characterized by that the washless stabilizing solution is added with said triazinylstilbene optical brightening agent in an amount of from 0.2 g to 10 g per liter of said washless stabilizing solution.

6. The processing method as claimed in claim 1, characterized by that said washless stabilizing solution has its pH ranging from 3.0 to 11.0.

7. The processing method as claimed in claim 6, characterized by that said washless stabilizing solution has its pH ranging from 6.0 to 11.0.

8. The processing method as claimed in claim 7, characterized by that said washless stabilizing solution has its pH ranging from 7.0 to 10.0.

9. The processing method as claimed in claim 1, characterized by that the amount of said washless stabilizing solution to be replenished is not more than 2 liters per sq. meter of the photosensitive material.

10. The processing method as claimed in claim 9, characterized by that the amount of said washless stabilizing solution to be replenished is not more than one liter per sq. meter of the photosensitive material.

11. The processing method as claimed in claim 10, characterized by that the amount of said washless stabilizing solution to be replenished is not more than 500 ml per sq. meter of the photosensitive material.

12. The process of claim 3 wherein said stabilizing solution is at a pH of 3.0 to 11 and said process further comprises introducing said compound of Formula (I), (II), (II') or (II'') into an emulsion layer or a layer adjacent to the emulsion layer of the photosensitive material in an amount of from 1 to 800 mg per square meter of photosensitive material before treatment with said stabilizing solution.

13. The process of claim 12 wherein 2 to 200 mg of said compound of Formula (I), (II), (II') or (II'') per square meter of photosensitive material are used.

14. The process of claim 4 wherein said stabilizing solution further contains 0.005 to 200 mg per liter of said compound of Formula (I), (II), (II') or (II'') and is at a pH of 3.0 to 11.

15. The process of claim 1 wherein said compound of Formula (I), (II), (II') or (II'') is:

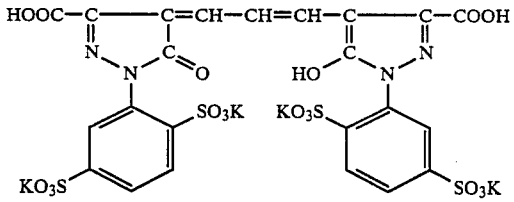

16. The process of claim 1 wherein said triazinylstilbene optical brightening agent is:

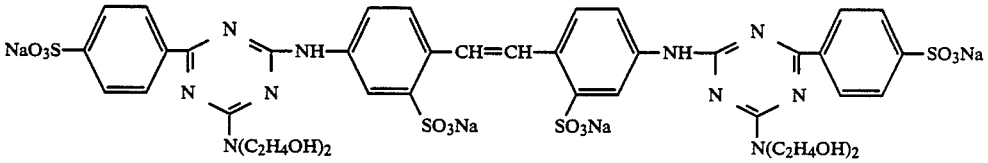

17. The process of claim 1 wherein said compound of Formula (I), (II), (II') or (II'') is:

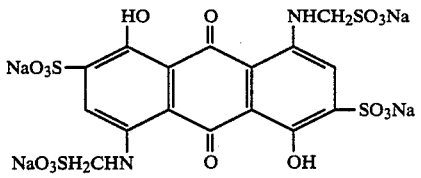
18. The process of claim 1 wherein said compound of Formula (I), (II), (II') or (II'') is:
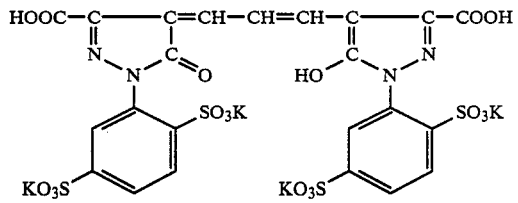
* * * * *